US009273918B2

(12) United States Patent
Amit et al.

(10) Patent No.: US 9,273,918 B2
(45) Date of Patent: Mar. 1, 2016

(54) APPARATUS AND METHOD FOR COUNTING ROUNDS FIRED FROM A FIREARM

(71) Applicant: ISRAEL WEAPON INDUSTRIES (I.W.I) LTD., Ramat HaSharon (IL)

(72) Inventors: Uri Amit, Kokhav Ya'ir (IL); Zeev Shneorson, Raanana (IL); Haim Sender, Ganei Tal (IL); Dedi Haitin, Ramat Gan (IL)

(73) Assignee: ISRAEL WEAPON INDUSTRIES (I.W.I) LTD., Ramat Hasharon (IL)

( * ) Notice: Subject to any disclaimer, the term of this patent is extended or adjusted under 35 U.S.C. 154(b) by 0 days.

(21) Appl. No.: 14/325,390

(22) Filed: Jul. 8, 2014

(65) Prior Publication Data

US 2015/0226505 A1 Aug. 13, 2015

(30) Foreign Application Priority Data

Feb. 10, 2014 (IL) ..... 230906

(51) Int. Cl.
*F41A 19/01* (2006.01)

(52) U.S. Cl.
CPC ..... *F41A 19/01* (2013.01)

(58) Field of Classification Search
CPC ..... F41A 19/01
USPC ..... 42/1.01, 1.03, 1.02
See application file for complete search history.

(56) References Cited

U.S. PATENT DOCUMENTS 4,001,961 A 1/1977 Johnson et al.
4,541,191 A 9/1985 Morris et al.
5,142,805 A * 9/1992 Horne et al. ..... 42/1.02
5,303,495 A 4/1994 Harthcock
5,406,730 A * 4/1995 Sayre ..... 42/1.02

(Continued)

FOREIGN PATENT DOCUMENTS

EP 1881292 11/2010
EP 2642237 9/2013

(Continued)

OTHER PUBLICATIONS

GS-Counter™ Secubit Ltd. Shots Counter GS-Counter™ for Glock (http://www.sebubit-ltd.com/products/gs-counter-glock/)
GS-Counter™ for Universal Picatinny Mount for AR-15, AK47 and more (http://www.secubitltd.com/products/picatiny/).

(Continued)

*Primary Examiner* — Bret Hayes
(74) *Attorney, Agent, or Firm* — Soroker-Agmon

(57) ABSTRACT

A round counter, comprising a detection unit to detect energy pulses resulting from an impact to a firearm; a round counter processor to analyze data obtained by the detection unit to count a number of rounds fired from the firearm; the round counter processor is configured to designate a time window data that is substantially a time length of an energy pulse; wherein the round counter processor compares the time window data to a firing window, the firing window is a predetermined time length required for discharging a round from the firearm; the time window has a substantial time span of firing at least two rounds; a firing counter increases the count when the round counter processor determines the time window data is larger than the firing window and transfers a command to the firing counter to increase the count of the firing counter.

20 Claims, 15 Drawing Sheets

(56) References Cited

U.S. PATENT DOCUMENTS

| | | | | |
|---|---|---|---|---|
| 5,566,486 | A * | 10/1996 | Brinkley | 42/1.02 |
| 7,143,644 | B2 | 12/2006 | Johnson et al. | |
| 7,669,356 | B2 | 3/2010 | Joannes et al. | |
| 8,215,044 | B2 | 7/2012 | Arbouw | |
| 8,387,295 | B2 * | 3/2013 | Glock | 42/1.02 |
| 8,464,452 | B2 | 6/2013 | Harper | |
| 8,571,815 | B2 | 10/2013 | Bar-David et al. | |
| 2005/0114084 | A1 * | 5/2005 | Johnson et al. | 702/183 |
| 2008/0039962 | A1 * | 2/2008 | McRae | 700/90 |
| 2008/0289485 | A1 | 11/2008 | Quinn | |
| 2009/0211139 | A1 * | 8/2009 | Ufer et al. | 42/1.03 |
| 2009/0277065 | A1 * | 11/2009 | Clark et al. | 42/1.03 |
| 2011/0067282 | A1 * | 3/2011 | August et al. | 42/1.03 |
| 2011/0072703 | A1 * | 3/2011 | Ferrarini et al. | 42/1.01 |
| 2011/0252683 | A1 * | 10/2011 | Chedid et al. | 42/1.03 |
| 2012/0131828 | A1 * | 5/2012 | August et al. | 42/1.02 |
| 2013/0219762 | A1 * | 8/2013 | Delgado Acarreta | 42/1.03 |

FOREIGN PATENT DOCUMENTS

| | | |
|---|---|---|
| IL | 183891 | 3/2012 |
| JP | 2008175526 | 7/2008 |

OTHER PUBLICATIONS

FN SmartCore®—http://www.fnherstal.com/primary-menu/products-capabilites/shot-counter/general.htm.

* cited by examiner

APPARATUS AND METHOD FOR COUNTING ROUNDS FIRED FROM A FIREARM

FIELD OF THE INVENTION

The subject matter relates generally to a method and apparatus for detecting and counting rounds fired from a firearm.

BACKGROUND OF THE INVENTION

Firearms endure conditions that reduce the efficiency and reliability of the firearm. Firing, cocking and other activities increase the chances of a malfunction in the firearm and risk of injury to the user of the firearm. One manner to monitor the wear and tear of firearms is by keeping count of how many rounds the firearm has fired, either during a shooting session, throughout the lifespan of the firearm, or some other desired timespan. System and computer program products have been developed for monitoring usage of man carried firearms, specifically to monitor ammunition level and weapon discharges through real time data collection, analysis and real time visual feedback to the operator using piezoelectric detectors attached to a gun barrel. The piezoelectric detector attached to the barrel of the firearm sometimes comprises a temperature detector, such as a thermometer, to monitor the increase in temperature of the barrel caused by firing of the firearm. Another manner of counting the shots fired from the firearm is through monitoring the acceleration of the moveable parts of the firearm, e.g. the cocking parts of a pistol.

U.S. Pat. No. 7,669,356 describes a device for counting shots based on measuring the acceleration of a barrel and moving parts of a firearm using an accelerometer.

The disadvantage of counting rounds in such a manner is that a firing signature created by the acceleration of the moving parts caused by the firing varies due to a mass of the firearm. This is most noticed when attachments are attached to the firearm, such as a scope, a grenade launcher, or the like. A further disadvantage of counting rounds in such a manner is that the firing position and how the weapon is held, would generate a different signature. This would apply to firing the weapon when it is held by hands or when the weapon is secured to a firing station, or when the weapon is used in connection with a bipod. Furthermore, the weight of a shooter of the firearm changes the acceleration of the moving parts. The signal changes and requires continuous resetting of the shot counter parameters to obtain accurate data for to counting the number of rounds discharged from the firearm.

SUMMARY

It is an object of the subject matter to disclose a round counter, comprising a detection unit configured to detect energy pulses resulting from an impact to a firearm; a round counter processor configured to analyzes data obtained by the detection unit to count a number of rounds fired from the firearm; wherein the round counter processor is configured to designate a time window data that is substantially a time length of an energy pulse; wherein the round counter processor compares the time window data to a firing window, wherein the firing window is a predetermined time length required for discharging a round from the firearm; a firing counter configured to store a number of round discharged from the firearm; wherein the firing counter increases the count when the round counter processor determines the time window data is larger than the firing window and transfers a command to the firing counter to increase the count of the firing counter; an energy source to power the round counter.

In some cases the round counter further comprising a other impact counter configured to store a number of other impacts to the firearm; wherein the round counter processor compares the time window data to a random impact window, wherein the random impact window is the predetermined time length of a random impact occurring to the firearm; wherein the other impact counter is increased by the count of one where the round counter processor determines the time window data is not greater than the random impact window. In some cases the round counter further comprising a release counter configured to store a number of times a release is performed on the firearm; wherein the round counter processor compares the time window data to a release window, wherein the release window is the predetermined time length required for the release of the firearm; wherein the releases counter increased by the count of one where the round counter processor determines the time window data is greater than the release window.

In some cases the round counter further comprises a transceiver configured to transmit the data stored in the firing counter, a release counter, an other impact counter, a rate of fire, a heavy firing sequence, time stamps and a combination thereof to a server.

In some cases the round counter operates in an engagement mode to collect the data of impacts to the firearm without transmitting and receiving the data.

In some cases the an external case comprises the round counter processor, the firing counter, a release counter, an other impact counter, and a transceiver.

In some cases the round counter further comprises a time stamp logger for obtaining a time stamp.

In some cases the round counter further comprises an RPM detector to store to calculate a rate of fire.

In some cases the round counter processor analyzes a heavy firing sequence of the firearm.

It is another object of the subject matter is to disclose a method performed on a round counter, comprising: detecting an impact to a firearm, wherein the impact is detected by a detection unit of the round counter; storing data in a time window data, wherein data comprises at least one sample of energy of the impact collected by the detection unit; determining whether the time window data is greater than a predetermined time length; collecting samples at a predetermined sample rate, wherein the at least one sample is collected by a round counter processor of the round counter, wherein the at least one sample comprises the energy measured by the detection unit; determining whether a no activity time length detected by the detection unit is equal to a substantial time span of firing of two rounds; comparing a round counter filter value to a predetermined time length value; determining whether more than three peaks were recognized and whether the time length is greater than a time required for firing two rounds when the round counter filter value is equal to the predetermined time length value; increasing a firing count by two counts when the three peaks are recognized and the time length is greater than the time required for firing the two rounds.

In some cases the method further comprises: retrieving the time window data when the three peaks were not recognized or that the time length is not greater than the time required for firing the two rounds; determining whether the time window data is not greater or equal to a wakeup window; increasing a release counter by one count when the time window data is not greater than the wakeup window and the time window data is not greater than a firing window or whether a pulse width is not greater than a predetermined pulse width.

In some cases the method further comprises: determining whether the time window data is greater or equal to the firing window and whether the pulse width is greater than the predetermined pulse width when the time window data not greater or equal to the wakeup window; increasing a firing counter by the one count when the time window data is greater than the firing window and that an energetic pulse width is greater than a predetermined level over a sampling window.

In some cases the method further comprises: determining the time window data is greater than a random impact window, wherein the random impact window is the predetermined time length representing the impact to the firearm; comparing the time window data to a release window, wherein the release window is the predetermined time length required for a release impact to the firearm; determining the time window data is smaller than the release window; increasing the release counter by a count of one where the time window data is smaller than the release window, wherein a release counter stores a number of times the cocking and release is performed on the firearm.

In some cases the method further comprises: determining the time window data is greater than a random impact window, wherein the random impact window is the predetermined time length representing the impact occurring to the firearm; comparing the time window data to a release window, wherein the release window is the predetermined time length required for release action of the firearm; determining the time window data is greater than the release window; determining the time window data is not greater than the firing window; increasing the release counter by a count of one where the time window data is greater than the wakeup window and not greater than the firing window, wherein a release counter stores a number of times the release is performed on the firearm.

In some cases the method further comprises: Initializing a round counter hardware; initializing parameters and variables of the round counter; setting the round counter to a standby mode for conservation of power.

In some cases parameters are received wirelessly using a transceiver of the round counter.

In some cases the method further comprises: determining the time window data is greater than a release window, wherein the release window is the predetermined time length required for release the firearm; comparing the time window data to a wakeup window, wherein the wakeup window is the predetermined time length required for the round counter to detect that a round was fired when the round counter is switched to a standard activity mode; determining the time window data is greater than the wakeup window; increasing a firing counter by the two counts where the time window data is greater than the wakeup window.

In some cases the method further comprises: setting the round counter to a standby mode for conservation of power; switching the round counter to a standard activity mode when the impact is detected; returning the round counter to the standby mode when no further impacts are detected.

In some cases the method further comprises: determining the firearm is not an open bolt firearm; retrieving an energy value for a last pulse value; determining a rate of decrease is greater than a predetermined decrease rate, wherein the rate of decrease is smaller than the predetermined decrease rate the round counter processor determines the impact was a random impact and performs step and returns to continuing processing; reducing a firing counter by one count.

In some cases the method further comprises: determining the firearm is an open bolt firearm; determining a ratio between a last measured energy pulse time value maximum and a previously measured energy pulse time value maximum; determining whether a time ratio between the last measured energy pulse time value maximum and the previously measured energy pulse time value maximum is smaller than a predetermined ratio value; reducing a firing counter by a single count when the ratio is smaller than a predetermined ratio value.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

DETAILED DESCRIPTION

The subject matter discloses method and apparatus for counting rounds fired from a firearm, according to exemplary embodiments of the subject matter.

Figure 1A:
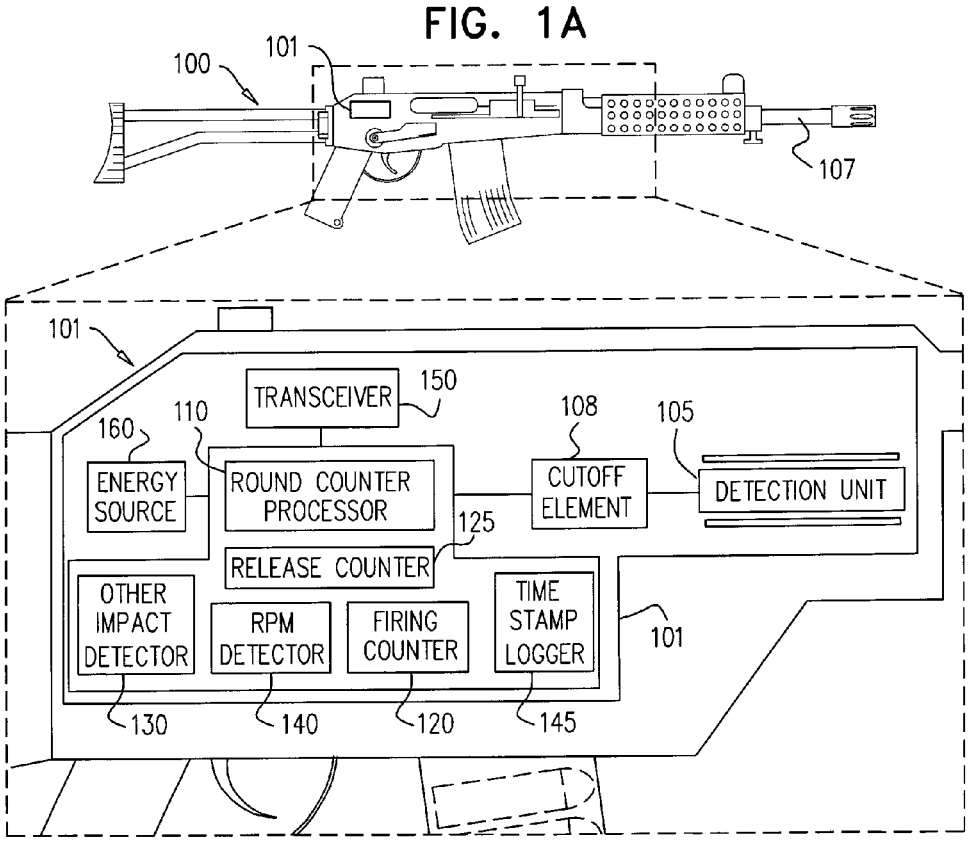
FIGS. 1A-1B show a round counter for detecting and storing data of an impact occurring on a firearm, according to exemplary embodiments of the subject matter.

FIG. 1A shows a round counter connected to a firearm for detecting and storing data of an impact occurring on the firearm, according to exemplary embodiments of the subject matter. The round counter 101 comprises a detection unit 105 configured to detect energy pulses resulting from an impact to the firearm 100. In some exemplary embodiments of the subject matter, the detection unit 105 is comprised of a piezoelectric sensor that records an electric charge released by mechanical stress caused to the firearm 100 by impacts. One such exemplary piezoelectric sensor can be the CR-03 seventy volts from Fuji Ceramics, Japan. An impact to the firearm 100 creates a force which compresses the piezoelectric sensor creating voltage signals representing the energy applied to the piezoelectric sensor, which is measured by the detection unit 105. The detection unit 105 collects samples of the piezoelectric sensor voltage signals output at a predetermined sampling rate, such as 3000 samples per second. The voltage signals output generated by the piezoelectric sensor is passed through a cutoff element 108 that cuts the voltage passing from the piezoelectric sensor in the detection unit 105 to a round counter processor 110 to the working voltage of a round counter processor 110. One non-limiting example of the working voltage can be 3.3 volts and in accordance with such example the cutoff element 108, would, cutoff voltage signals output higher than 3.3 volts. In some exemplary embodiments of the subject matter, the use of a seventy volt piezoelectric sensor enables sufficient energetic resolution to be provided in the samples provided after the cutoff and below the 3.3 volts level for the round counter processor 110 to determine and distinguish various impacts to the firearm 100. The voltage signals output transferred to the round counter processor 110 is converted into samples of data, which can be analyzed by the round counter processor 110. The round counter processor 110 analyzes the data to determine if the firearm 100 discharged a round. In some alternative exemplary embodiments of the subject matter the round counter processor 110 analyzes the data to determine if the firearm 100 was cocked or received an impact which is neither the cocking of the firearm 100 nor the discharge of a round. Each impact type may comprise one or more energy peaks and one or more energy pulses. Each energy pulse of the one or more energy pulses comprises characteristics that are different in a length of the energy pulse, width of the energy pulse, time and time length of the energy pulse. The round counter processor 110 analyzes the data samples for data samples' energy pulse's characteristics. The round counter processor 110 determines from one or more such data samples what kind of impact type occurred to the firearm 100. In some exemplary embodiments of the subject matter three data samples (representing three signals from the detection unit 105) are designated by the round counter processor 110 as a time window. The time window is analyzed by the round counter processor 110 to determine whether the firearm was fired, and alternatively whether the firearm 100 was cocked, or experienced some other impact. In some other exemplary embodiments of the subject matter the time window comprises two or more data samples each data sample representing an output signal from the piezoelectric sensor. Time windows are analyzed in succession in accordance with the method further detailed herein below. When a predetermined energy level is detected over a predetermined length of time, for example in a single time window, the round counter processor 110 determines that a round was discharged from the firearm 100 and increases a count to a firing counter 120. The firing counter 120 stores the number of rounds discharged from the firearm 100.

In some other exemplary embodiment of the subject matter where the round counter processor 110 determines that the predetermined energy level has not been reached for the time length comprising the single time window, the round counter processor discards the data samples associated with the time window. Alternatively, the round counter processor 110 may detect that the energy level and time window are sufficient to record another impact to the firearm 100 and therefore increases the other impact counter 130. In addition, certain energy levels over a predetermined length of time may be sufficient to identify that the bolt of the firearm has moved in the forward direction (towards the barrel) while there was no discharge of a round, whether or not the bolt reached the firing chamber. Such detection may be disregarded or recorded by increasing the other impact counter 130. The other impact counter 130 may also store the number of other impacts caused to the firearm 100, for example cocking of the firearm.

In some exemplary embodiments of the subject matter, the round counter 101 comprises a release counter 125, which counts a release performed by the user of the firearm 100. The release occurs as part of cocking of the firearm 100. The detection unit 105 detects the impact caused by the release. The round counter processor 110 designates the time window to the release and compares the time window to a release window, which is a predetermined time length of performing a release on the firearm 100. Where the time window is smaller than the release window, the round counter processor 110 increases the release counter 125 by a one count. In some non-limiting cases, the release counter 125 is increased where the time window is smaller than a firing window and a pulse is greater than a predetermined pulse width the release counter is increased by the one count. The method is further described in FIG. 5 herein.

The round counter 101 may comprise an RPM detector 140 to store the number of times the firearm 100 discharged more than two rounds in succession and the successive firing period of time, thus enabling the round counter processor 110 to determine the rounds discharged per minute, when such successive firing began and when such successive firing ended. The RPM detector 140 can further determine if the firearm 100 manufacturer's instructions of successive firing was exceeded. For example, the Negev 5.56 mm manufactured by Israeli Weapons Industries, Ramat HaSharon, Israel, which is a light machine gun with successive rate of fire that should not exceed 80 bullets per minute. If the RPM detector 140 determines that more than 80 rounds were discharged in under a minute, the round counter processor 110 may record such an infraction. The infraction may be recorded using a time stamp obtained from a time stamp logger 145, which may also be the internal time clock of the round counter processor 110. In some cases, the time stamp logger 145 is used to obtain a time period for firing of the firearm 100. For example, a supervisor wants to a time stamp to determine how many rounds were fired during the time period of a day, the time stamp logger 145 provides a time stamp of the day on which the rounds were fired from the firearm 100.

Figure 3:
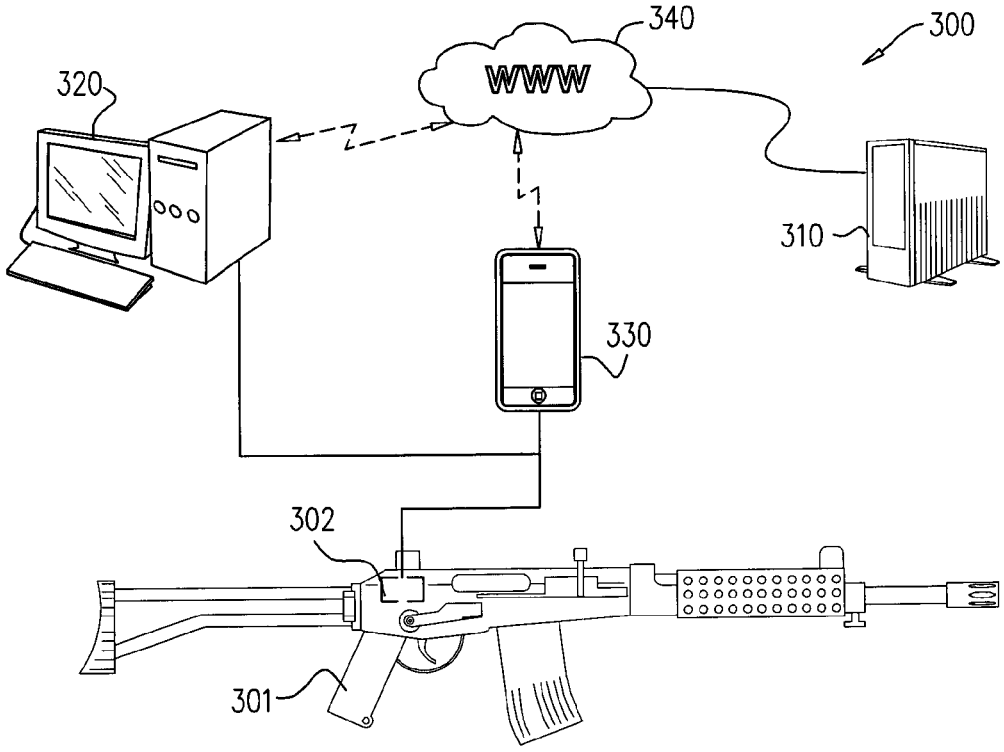
FIG. 3 shows an environment for counting rounds fired from a firearm, according to some exemplary embodiments of the subject matter.

The round counter 101 may comprise a transceiver 150, which enables the round counter 101 to transmit the data collected by the round counter 101 to a computerized device 320 of FIG. 3, a mobilized device 330 of FIG. 3, which enables review of the data for maintenance of the firearm 100. The transceiver 150 transmits the data stored in the firing counter 120, the release counter 125, the other impact counter 130, a rate of fire, a heavy firing sequence, time stamps or a combination thereof. The round counter 101 comprises an energy source 160, which powers the round counter 101. The energy source 160 may comprise a battery, a solar panel, or a renewable energy source, a chemical energy source, or a generator which powers the round counter 101 from the movement of moving parts in the firearm 100. For example, when the firearm 100 discharges the round, a movement of a bolt (not shown) in the firearm 100 is converted into energy, such as for example by charging a battery, to power the round counter 101.

In some exemplary embodiments of the subject matter, the round counter 101 switches between an active mode and a standby mode. In the active mode the round counter 101 is functioning at a high power consumption so as to detect the rounds fired and to process the data collected. In the standby mode the round counter 101 uses a minimal amount of power, required only to enable the round counter processor 110 to be activated when voltage is received from the detection unit 105. Once, voltage over a predetermined level, such as for example 50-60 millivolts arrive to the round counter processor 110 from the detection unit 105, the round counter processor 110 switches the round counter 101 to the active mode and collects further data of impact to the firearm 100 as well as processes the collected data.

Figure 1B:
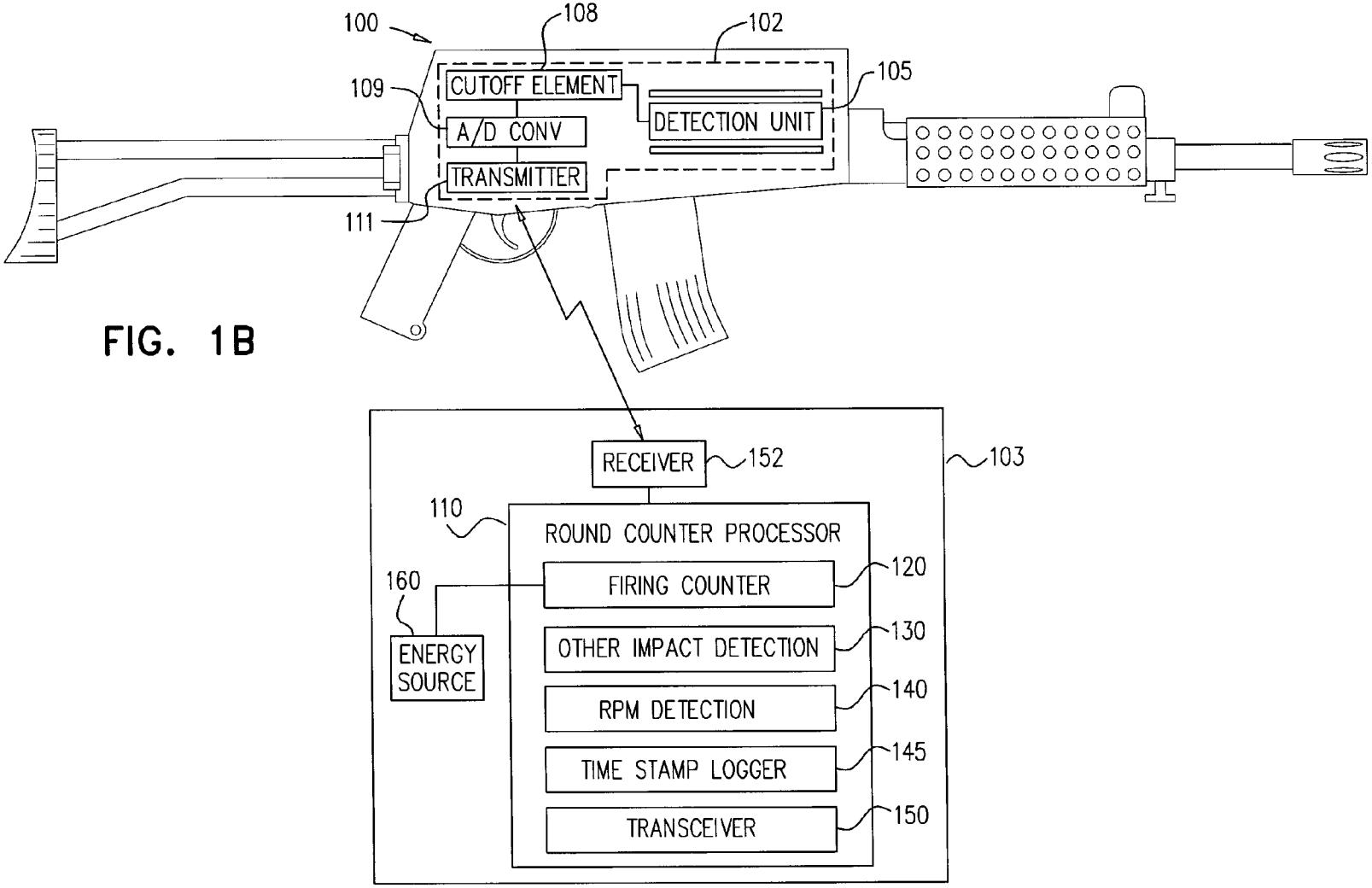

FIG. 1B shows a firearm 100 with a remote round counter, according to some exemplary embodiments of the subject matter. According to exemplary embodiments of the subject matter when the firearm 100 is equipped with the round counter 110 in an external case 103, a weapon round counter 102 is installed inside, or is attached to the firearm 100. The weapon round counter 102 is configured to detect and transmit information to the remote round counter 103. The weapon round counter 102 is comprised of the detection unit 105 and the cutoff element 108 as further disclosed and described in connection with FIG. 1A. In addition, the weapon round counter 102 further comprises an analog to digital convertor 109 and a transmitter 111. According to exemplary embodiments of the subject matter signals passed through the cutoff element 108 are converted to digital signals and are passed to the transmitter 111, which transmits the digital signals to the remote round counter 103. The transfer of the digital signals can be through a wired connection or a wireless connection, such as near field communication, Bluetooth, or the like. The remote round counter 103 comprises the round counter processor 110 elements described in further detail in accordance with the description relating to FIG. 1A. The remote round counter 103 further comprises a receiver 152 configured to receive the digital signals transmitted by transmitter 111.

Figure 2:
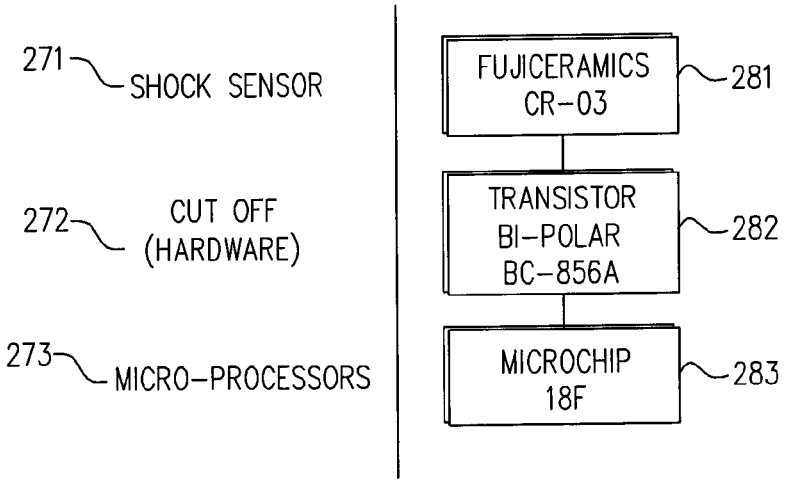
FIG. 2 shows a schematic diagram of a detection unit and a cutoff element, according to some exemplary embodiments of the subject matter.

FIG. 2 shows a schematic diagram of the detection unit 105 of FIGS. 1A, 1B and the cutoff element 108 of FIGS. 1A, 1B, according to some exemplary embodiments of the subject matter. The detection unit 105 comprises a shock sensor 271, which in some exemplary embodiments is a Fuji Ceramics CR-03 281. In some non-limiting examples, the Fuji Ceramics CR-03 may be a Fuji Ceramics CR-03R with a voltage sensitivity of 0.87 $mV/m/s^2$, or Fuji Ceramics CR-03BM with a voltage sensitivity of 2.5 $mV/m/s^2$. The detection unit 105 is connected to the cutoff element 108. The cutoff element 108 comprises cut off hardware 272, which may be a PNP Bi-Polar BC-856A transistor 282. The cut off hardware 272 provides a cutoff voltage value to the circuit voltage of the detection unit 105. One non-limiting example is the PNP Bi-Polar BC-856A transistor 282 providing a cutoff limit of three volts, such that any voltage higher than that value is not transferred to the round counter processor 110 of FIGS. 1A, 1B. In some exemplary embodiments of the subject matter, the round counter processor 110 is a microprocessor 273, such as a Microchip 18F (283). In some exemplary embodiments of the subject matter the use of a high voltage sensitive shock detector enables more sensitive detection of energetic events to the firearm 100 of FIGS. 1A, 1B. The use of a cutoff element is required so as to enable transferring the detection unit 105 signal having a maximum voltage of said unit. Use of a lower voltage shock detection sensor would mean that some energetic events would not be recorded or sensed.

FIG. 3 shows an environment for counting rounds fired from a firearm, according to some exemplary embodiments of the subject matter. The environment 300 comprises a firearm 301. The firearm 301 may be an automatic firearm, a semi-automatic firearm, a bolt action firearm, or the like. One example of the firearm is the Negev 5.56 mm light machine gun or the Negev NG7 7.62 mm both manufactured by Israeli Weapons Industries, Ramat HaSharon, Israel ("Negev"). The firearm 301 comprises a round counter 302, which detects when the firearm 301 discharges a round. The round counter 302 may be attached to the exterior or interior of the firearm 301, or may be built into the firearm 301. In some exemplary embodiments of the subject matter, the round counter 302 separately determines the number of times the firearm 301 is cocked or receives a random impact, such as the firearm 301 falls on the floor. The round counter 302 may comprise a transceiver (not shown), which transmits firing data, such as the number of rounds fired by the firearm 301 to a computerized device 320, a mobilized device 330, or a combination thereof. The computerized device 320 enables a person to view data collected by the round counter 302 relating to the number of rounds discharged or data relating to other impacts caused to the firearm 301.

The server 310 receives and stores data collected by the round counter 302. The server 310 may request and receive in response data collected by the round counter 302.

The computerized device 320 and the mobilized device 330 may be connected to the server 310 through a data network, such as for example, the world wide web ("WWW") 340.

A person using the computerized device 320 or the mobilized device 330 may review the number of times the firearm 301 was fired, the number of rounds discharged from the firearm 301, whether the firing rate of the firearm 301 was excessive, the number of times the firearm 301 was cocked, or experienced a random impact.

The data enables the person to monitor the use of the firearm 301 as well as establish maintenance requirements of the firearm 301 according to the use and the impacts occurring to the firearm. For example, the person viewing the data of the round counter 302 sees that the firearm 301 fired 60,000 rounds, which is the number of rounds fired after which the firearm 301 requires replacement of a firing bolt assembly (not shown), at which point the firearm 301 may be serviced accordingly. The data further enables the person to monitor the ammunition consumption by a single shooter or by all the shooters of the firearm 301. In some cases, the data is collected for multiple firearms and the ammunition consumption for a group of people may be monitored. For example, the person monitors the ammunition consumption of a squad or a platoon.

In some exemplary embodiments of the subject matter, the server 310, the computerized device 320 or the mobilized device 330 may comprise a list of firearms, wherein each firearm of the firearms comprises the round counter 302. The list enables the person to monitor multiple firearms at a same time. For example, where the firearms are used at a firing range, the person may be a firing range employee who is monitoring the use of the firearms during the firing of the firearms. In some exemplary embodiments of the subject matter, the round counter 302 may be calibrated to detect when the firearm 301 is being carried, for example, by a soldier carrying the firearm 301 from an armory. The detection of carrying may be transferred to the server 310 from which a supervisor may view when the firearm 301 is being moved.

Figure 4A:
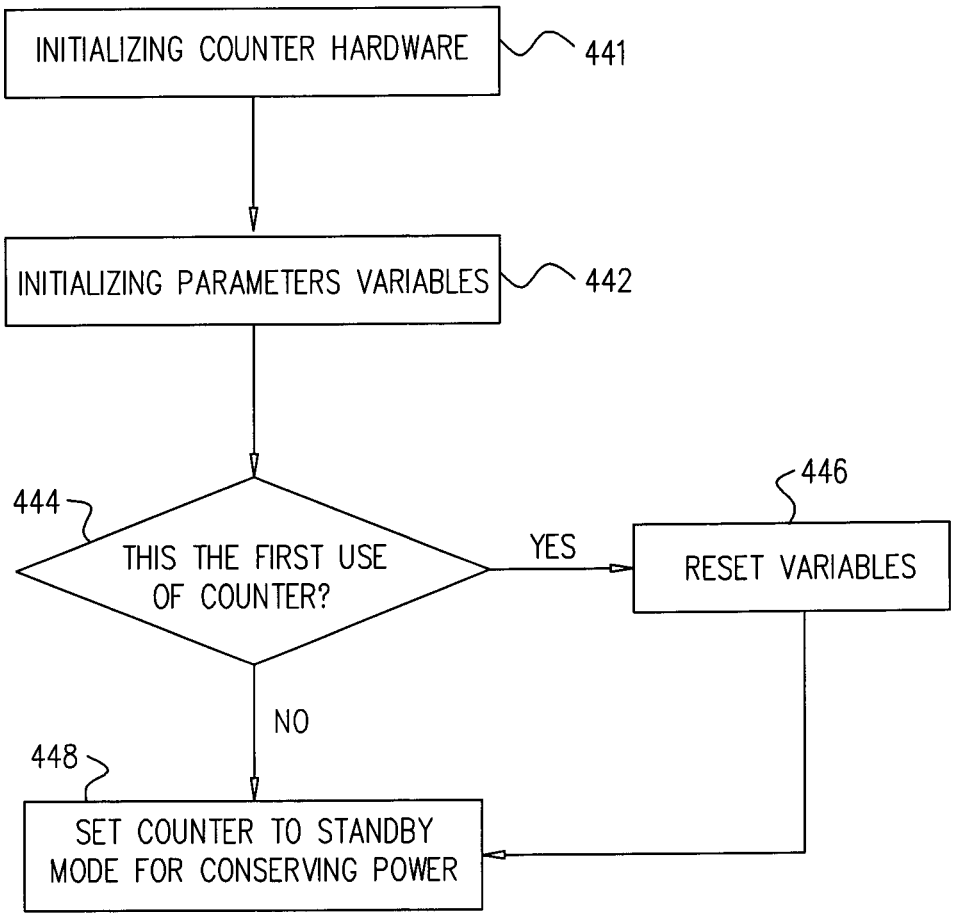
FIGS. 4A-4B show a method for detecting an impact occurring to a firearm, according to some exemplary embodiments of the subject matter.

FIG. 4A shows a method for initializing a round counter, according to some exemplary embodiments of the subject matter. Step 441 discloses initializing a round counter hardware, for example, connecting the round counter 101 of FIG.

1A, 1B to the energy source 160 of FIG. 1A,1B, such as batteries or where the round counter 101 is first installed in the firearm 100 of FIG. 1A.

Step 442 discloses initializing parameters and variables of the round counter 101. The round counter 101 is calibrated to the firearm 100 on which the round counter 101 is located. The calibration may include setting the parameters for firearm weight, ammunition caliber, firearm barrel length, and the like. The calibration is done to ensure that the same count is accomplished with the round counter 101 regardless of whether the firearm 100 is carried by a person or attached to a fixed location, and regardless of the type of additional accessories attached thereto prior or after the calibration in step 442 is performed. However, the round counter 101 provides consistent results regardless of the type of ammunition used with the firearm 100, the size of the or firing position of the shooter of the firearm 100 or the like. In some cases, the parameters are measured and calculated during tests of the firearm 100, so the calibration of the round counter 101 is firearm 100 specific. The round counter 101 may store data such as a firearm serial number, a user name, or the like.

Step 444 discloses determining whether the round counter 101 is used for a first time. Where the round counter 101 is used for the first time, step 446 discloses resetting the variables of the round counter 101. Where the round counter 101 is not used for the first time or after completion of step 446, the round counter 101 performs step 448 disclosing to set the round counter 101 to a standby mode for conserving power. In standby mode, the round counter 101 works on a minimal amount of power to enable the round counter 101 to be functional over long periods of time without requiring frequent changing of the power source and without requiring a carrier of the firearm 100 from carrying a large power source.

Figure 4B:
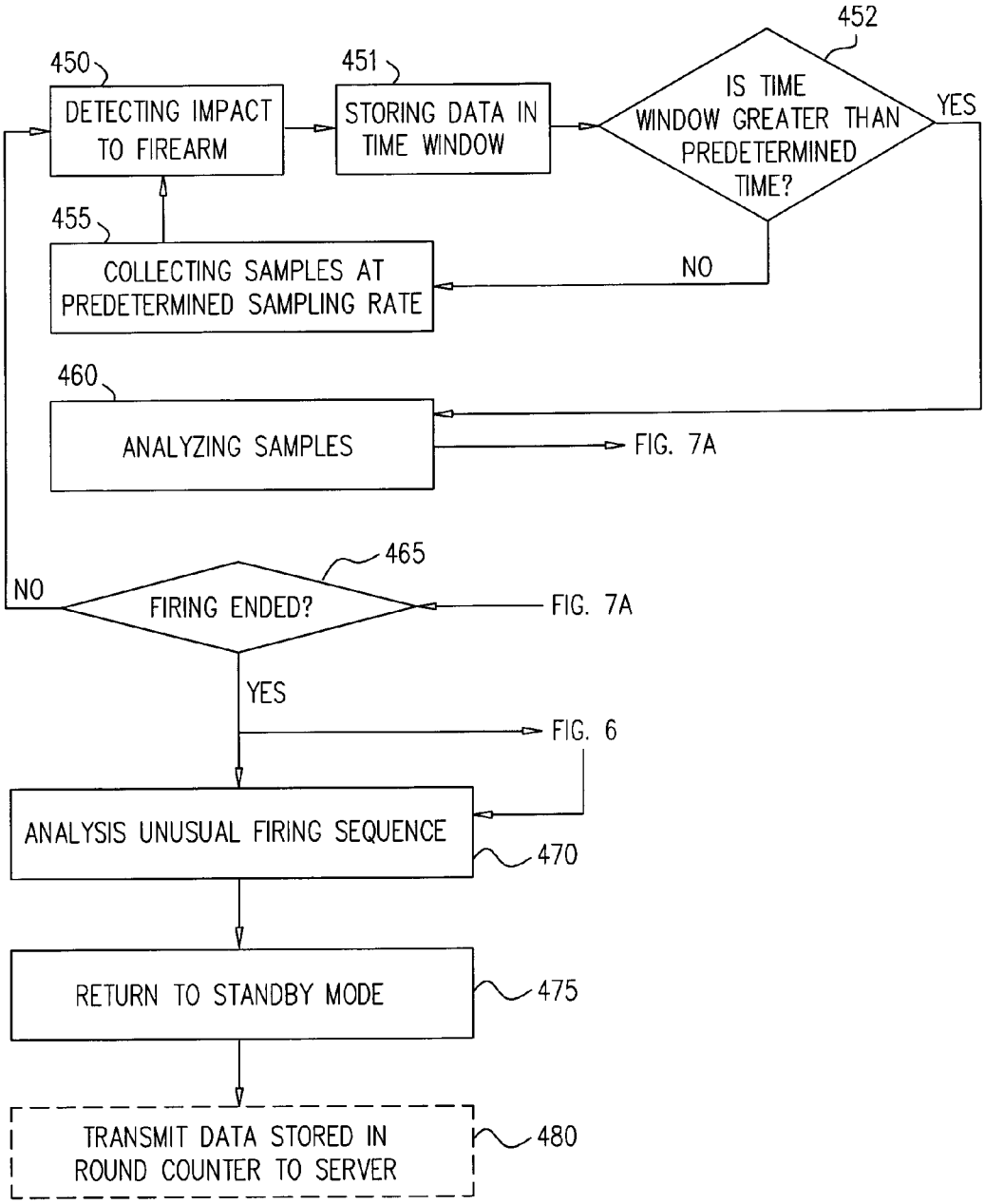

FIG. 4B shows a method for detecting an impact occurring to a firearm, according to some exemplary embodiments of the subject matter. Step 450 discloses detecting an impact to the firearm 100 of FIGS. 1A,1B, where the impact is detected by the detection unit 105 of FIGS. 1A,1B. In some cases, the round counter 101 of FIG. 1A is in standby mode for conservation of energy. When the detection unit 105 detects a significant impact, the detection unit 105 generates a voltage pulse that is cut off by the cutoff element 108 of FIG. 1A. This awakens the round counter processor 110 FIG. 1A and that in turn switches the round counter 101 to an active mode. In the active mode the round counter 101 is configured to determine that one or more rounds were discharged from the firearm 100 and to count the number of rounds discharged from the firearm 100 as is provided herein. The round counter 101 collects data of the impact and any impact that may occur after a first detection.

Step 451 discloses storing the data in a time window. The data is stored in the time window over a time length of impacts being detected by the detection unit. The data comprises at least one sample of energy of the impact collected by the detection unit. The time window represents a length of time in which an energy pulse is sampled by the round counter processor 110. Step 452 discloses determining whether the time window is greater than a predetermined time length. For example, the predetermined time length is one hundred five milliseconds. The round counter processor 110 compares the time window to the predetermined time length. Where the time window is smaller than the predetermined time length, the round counter processor 110 performs step 455.

Step 455 discloses collecting samples at a predetermined sample rate, for example, 3000 samples per second. The samples are collected by the detection unit 105, which collects energy data. The energy data comprises measurements of energy released by the impact caused to the firearm 100. The round counter processor 110 continues sampling for a designated time. Where another impact is detected by the detection unit 105, the round counter performs step 450 again. Where no impact is detected in the designated time, for example forty milliseconds, the round counter processor 110 returns to the standby mode.

Where the time window is determined in Step 452 to be greater than the predetermined time length, the round counter processor 110 performs step 460. Step 460 discloses analyzing the samples transferred from the detection unit 105 through the cutoff element 108 to the round counter processor 110. The analysis comprises determining what type of impact occurred to the firearm 100 as further provided in association with FIGS. 7A, 7B, and further updating counters, such as the firing counter 120 of FIG. 1A, or the other impact counter 130 of FIG. 1A. In some exemplary embodiments of the subject matter in step 460 the RPM detector 140 of FIG. 1A is configured to determine the actual rate of fire of the firearm 100. In some exemplary embodiments of the subject matter in step 460 when the round counter processor 110 determines that a round was discharged the time stamp logger 145 of FIG. 1A provides a time stamp for the time and date the round was discharged. Such time stamp may be recorded in the firing counter 120.

Step 465 discloses the round counter determining whether the firing of one or more rounds from the firearm 100 has terminated. In cases where the firing of the firearm 100 is not terminated the round counter 101 returns to step 450 to detect another impact to the firearm.

Figures 5, 7A:
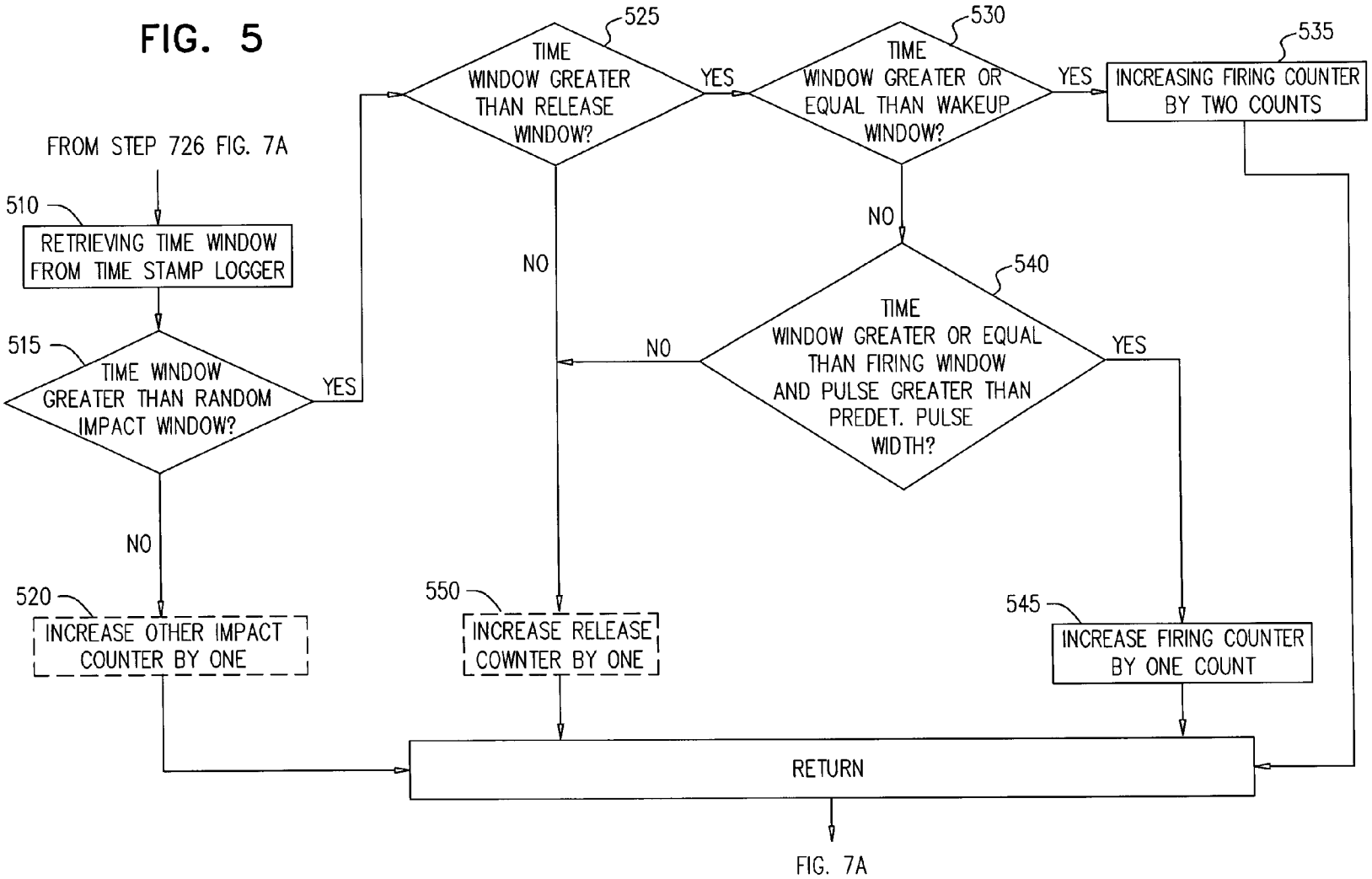
FIG. 5 shows a method for differentiating a type of impact that occurred to a firearm, according to exemplary embodiments of the subject matter.
FIGS. 7A-7B show a method for counting a firing count in a round counter, according to some exemplary embodiments of the subject matter.
Figure 6:
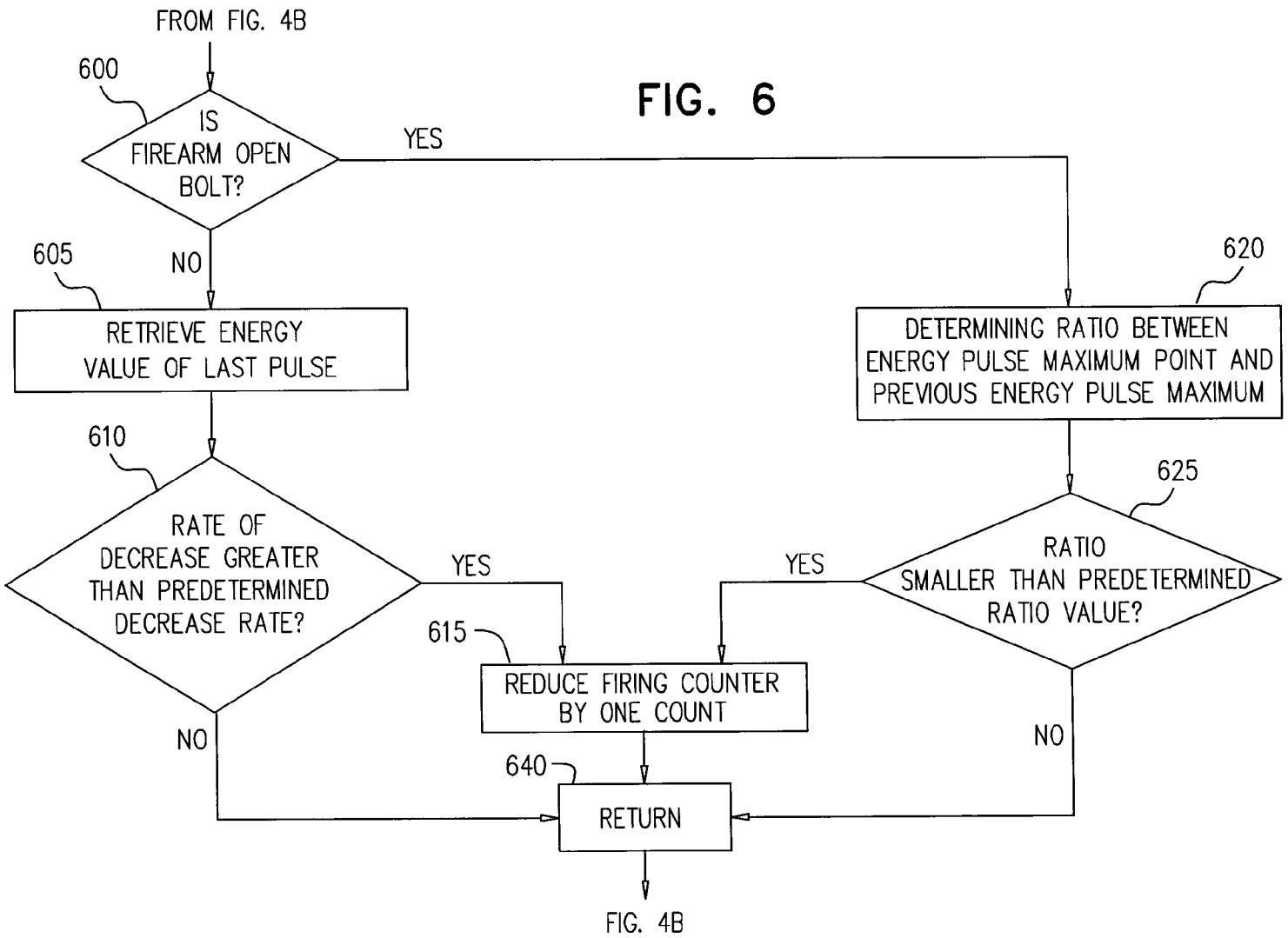
FIG. 6 shows a method for determining a final round was fired from a firearm, according to some exemplary embodiments of the subject matter.

When the firing of the firearm 100 has terminated, the round counter 101 performs an analysis associated with FIG. 6. After completion of the analysis discloses here in FIG. 5, the round counter processor 110 performs step 470 of analyzing unusual firing sequences of the firearm 100. The analysis of unusual firing sequences is performed to determine of continuous discharge of multiple rounds was performed. Such analysis may be termed heavy fire sequence. Such heavy fire sequence may be recorded if the round counter processor 110 determines that the detected firing sequence exceeded the manufacturer's recommendation for use of a specific firearm used.

In some cases in step 470 the round counter processor 110 also performs an analysis that a count of the number of rounds fired by the firearm is correct. The analysis is further used to determine situations where the detection unit 105 may have detected impacts during firing of the firearm but that did not lead to actual discharge of a round. In some cases, the analysis is used to determine situations where there was a random impact while the firearm was firing and to correct the count to not include the random impact. After the analysis of unusual firing sequences is completed and no other impacts are detected within a predetermined about of time, the round counter 101 may perform step 475 to return to standby mode to conserver power.

In some exemplary embodiments of the subject matter, the round counter 101 performs step 480 which discloses transmitting data of the round counter 101 to the server 310 of FIG. 3. The data transmitted comprises the number of counts in the firing counter 120 of FIG. 1A, or other data such as the other impact counter 130 of FIG. 1A or other data recorded by the round counter 101. The server 310 stores the data received from the round counter 101 such that the use of the firearm 301 is monitored. In some other exemplary embodiments of the subject matter, in step 380 the round counter 101 sends data to the server 310 of FIG. 3 or to other external device upon a query received from an external device, for example, the computerized device 320 of FIG. 3.

In some exemplary embodiments of the subject matter, the round counter 101 comprises an engagement mode of operation. In the engagement mode the round counter 101 continues counting the number of rounds fired without transmitting or receiving data. The round counter 101 stores the data in the respective counters until the round counter 101 receives a command to return to the active mode in which the round counter 101 performs the analysis of the data collected while in the engagement mode. Turning the round counter 101 to the engagement mode enables conserving of the energy source 160 of FIG. 1 such that the round counter 101 may collect data for longer periods of time prior to replacement of the energy source 160. The data is analyzed and the rounds are counted by the round counter 101 when some command is received by the round counter 101. For example, the round counter 101 receives a command from the computerized device 320 of FIG. 3 to return to a standard activity mode and determine how many rounds were fired. In some cases, the return to the standard activity mode may occur when the firearm 100 of FIG. 1 is returned to a predetermined spot. For example, the firearm 100 is returned to an armory, where the round counter 101 receives a command from the server 310 to return to the standard activity mode and analyze the data collected during the engagement mode. In some non-limiting embodiments the round counter 101 receives a command to switch to the engagement mode from the computerized device 320 or the mobilized device 330. For example, a squad leader uses his mobilized device to switch the firearms of his squad to the engagement mode until after a drill is completed, or until the firearms are returned to the armory.

FIG. 5 shows a method for analyzing the samples collected in step 455 of FIG. 4B, according to exemplary embodiments of the subject matter. As explained above, energy measured by the detection unit 105 of FIGS. 1A, 1B is transferred through the cutoff element 108 of FIGS. 1A, 1B and is sampled by the round counter processor 110 of FIGS. 1A, 1B at a predetermined rate, for example, 3,000 samples per second. The samples are analyzed according to the method disclosed in FIG. 7A. Where the round counter processor 110 determines that the requirements of step 725 of FIG. 7A were not met as is disclosed herein, the round counter processor 110 performs the analysis of FIG. 5.

Step 510 discloses retrieving a time window data. The time window data is stored by the round counter 101 of FIG. 1A and obtained by the round counter processor 110 for the method disclosed. The time window data represents a length of time in which an energy pulse is sampled by the round counter processor 110. For example, the time window data is of a time length of one hundred five milliseconds. The time window data is designated at a predetermined length which can change from firearm to firearm. For example, for the Negev the predetermined time window data can be 105 milliseconds.

Step 515 discloses determining whether the time window data is greater than a random impact window. A random impact to the firearm 100 of FIGS. 1A, 1B, such as the firearm 100 falling to the ground, may be detected by the detection unit 105 and after analysis the round counter processor 110 may determine that the impact to the firearm 100 did not discharge a round. The round counter processor 110 compares the time window data with a random impact time window, which is a predetermined time length for the energy pulse caused by a random impact to the firearm 100. For example, the random impact time window can represent a time length of seven milliseconds. Where the time window data is smaller than the random impact time window, the round counter processor 110 may optionally perform step 520, which discloses increasing the other impact counter 130 of FIGS. 1A, 1B by a single count. The round counter processor 110 then performs step 560 of returning to wait for the next sample to be received.

Where the time window data is larger than the random impact time window, the round counter processor 110 performs step 525 to determine whether the time window data is greater than a release window. The release window is the predetermined time it takes the firearm's bolt to travel from the most rear position to the most forward position, where the round is locked in the firing chamber. For example, the random time window can represent a length of eighteen milliseconds. Where the time window data is smaller than the release window, the round counter processor 110 then performs step 560 of returning to wait for the next sample to be received. Optionally in step 550 the release counter 125 of FIG. 1A is increased by one.

Step 530 discloses determining whether the time window data is greater or equal to a wakeup window. The wakeup window is a predetermined time length of firing two shots from the firearm 100 where the round counter 101 resumes activity from standby mode. Where the time window data is smaller than the wakeup window, the round counter processor 110 performs step 535 and increases the firing counter 120 by two counts.

Where the time window data not greater or equal to the wakeup window, the round counter processor 110 performs step 540 disclosing to determine whether the time window data is greater or equal to a firing window and whether a first pulse width is greater than a firing pulse time. The firing window is the time required for the firearm 100 to discharge a round. This firing window can be predetermined and would typically depend on the firing time of the firearm used. For example, the firing window for a Negev may be nineteen milliseconds. The energetic pulse width is the energy level detected by the detection unit 105 and transferred to the round counter processor 110 through the cutoff element 108. Since the cutoff element 108 would allow transfer of voltage under a predetermined level, such as for example three volts, the round counter processor 110 would receive energy values between 0-3 volts over a sampling window, which may be 0.3 milliseconds. For each firearm it is determined which energy values over the sampling windows indicate that the firearm 100 was discharged. Where the round counter processor 110 determines that the time window data is greater than the firing window and that the energetic pulse width is greater than a predetermined level over the sampling window, the round counter processor 110 performs step 545 which discloses increasing the firing counter 120 by one count. After the count of the firing counter 120 is increased, the round counter processor 110 returns to FIG. 7A to continue the method disclosed therein.

FIG. 6 shows a method for determining a final round was fired from a firearm, according to some exemplary embodiments of the subject matter. In connection with the description of FIG. 4B, after the firearm 100 of FIG. 1A has ceased firing, the round counter processor 110 of FIG. 1A performs the method to determine whether a final energy pulse was a round fired from the firearm or some other random impact. The round counter processor 110 commences the method at a predetermined time after the last impact was detected by the detection unit 105 of FIG. 1A, for example after 140 milliseconds, and no additional signal was received from the detection unit 105. Alternatively, in some exemplary cases of the subject matter, the round counter processor 110 performs the method where more than two rounds were detected after the said exemplary 140 milliseconds where no additional signal was received from the detection unit 105.

Step 600 discloses determining whether the firearm 100 is an open bolt firearm. The determination of whether the firearm 100 is open bolt firearm may be part of the initialization of parameters of the round counter 101 of FIG. 1A in step 441 of FIG. 4A. Where the firearm 100 is not an open bolt, for example, the firearm 100 is an AR15 manufactured by Colt Industries, United States, the round counter processor 110 performs step 605, which discloses retrieving an energy value for a last pulse value received from step 740 of FIG. 7B described herein.

Step 610 discloses determining whether the rate of decrease is greater than predetermined decrease rate. The drop rate is to determine the drop in energy, such as voltage, of the energy pulse. For example, if the firearm used is the Negev, the over the round counter processor 110 determines whether there was a decrease of 600 mv over a time period of 13 milliseconds. Where the rate of decrease is greater than the predetermined decrease rate the round counter processor 110, determines the impact was not a shot and performs step 615 to reduce firing counter by single count and returns to continuing processing as is provided further in FIG. 4B. Where the rate of decrease is smaller than the predetermined drop rate, the round counter processor 110 performs step 640. For example, the rate of decrease is greater than 600 mv over the time of 13 milliseconds. After reducing the firing counter 120, the round counter performs step 640 and returns to continuing processing as is provided further in FIG. 4B.

In some exemplary embodiments of the subject matter, the firearm 100 is an open bolt, such as the Negev. In such case, the round counter processor 110 performs step 620 which discloses determining a ratio between a last measured energy pulse maximum value and a previously measured energy pulse maximum value.

Step 625 discloses determining whether the time ratio between the last measured energy pulse maximum value and the previously measured energy pulse maximum value is smaller than a predetermined ratio value, for example 90% or 0.9. Where the pulse rate is not smaller than the predetermined ratio the round counter 101 performs step 640 and returns to continuing processing as is provided further in FIG. 4B. Where the ratio is smaller than a predetermined ratio value, the round counter 101 performs step 615 which discloses reducing the firing counter by a single count. After reducing the firing counter 120 the round counter performs step 640 and returns to continuing processing as is provided further in FIG. 4B.

Figure 7A:
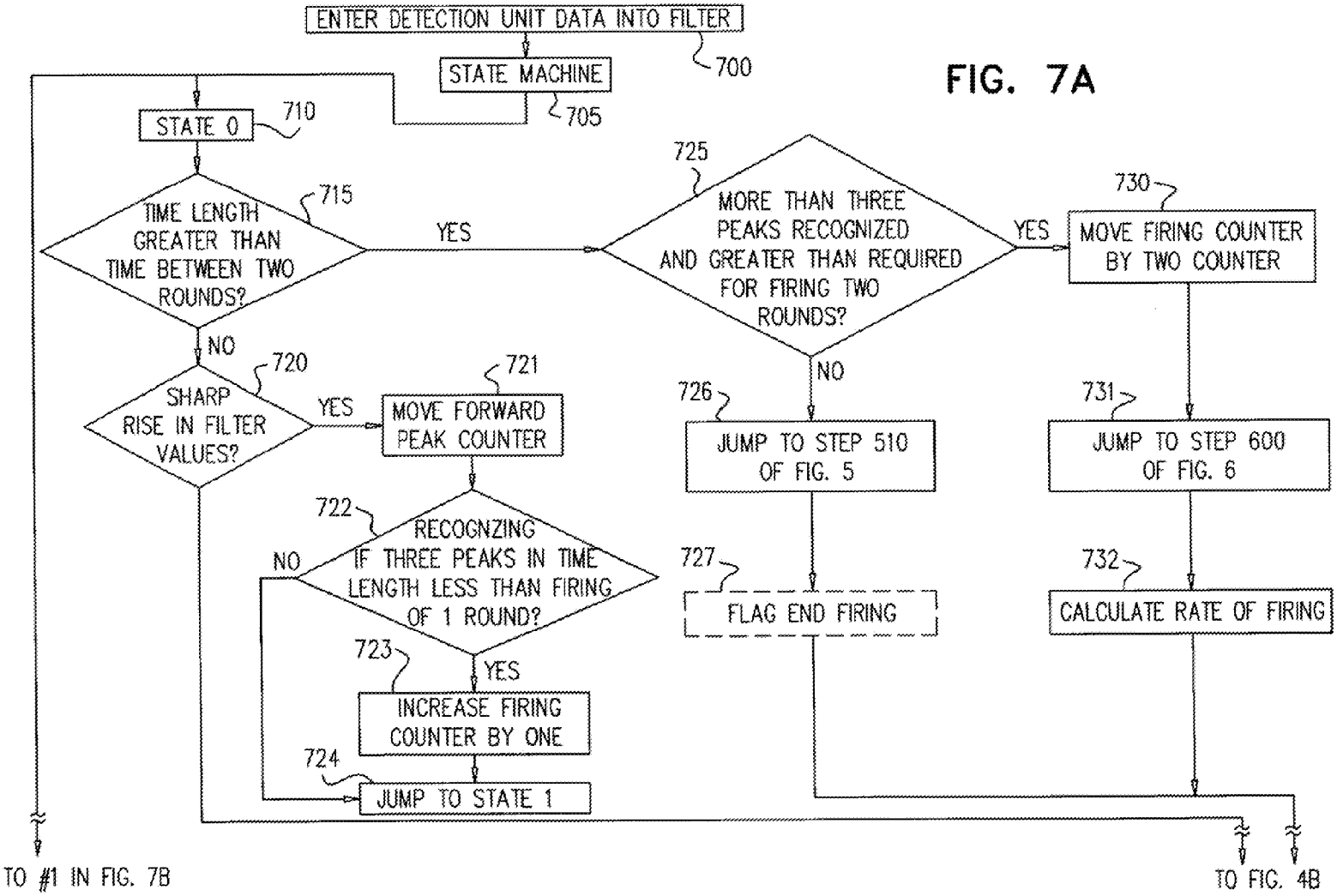
Figure 7B:
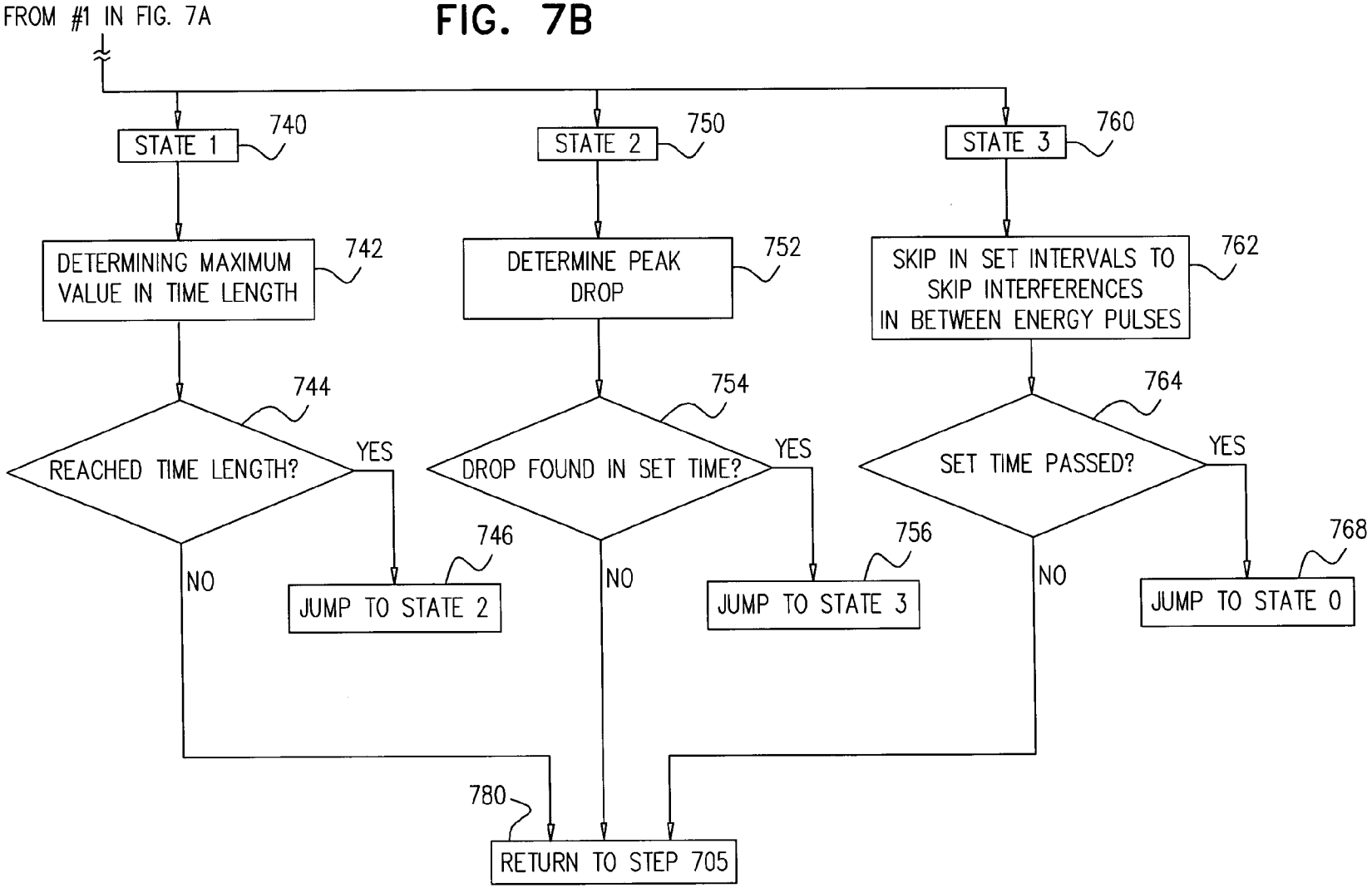

FIG. 7A-7B show an alternative embodiment for a method for counting rounds fired by the firearm 100 of FIG. 1A, according to some exemplary embodiments of the subject matter. The method shown in FIGS. 7A-7B occurs at step 460 of FIG. 4B after the round counter 101 of FIG. 1A collected samples of impacts caused to the firearm 100.

Looking at FIG. 7A, step 700 discloses applying a round counter filter. The round counter filter is designed to allow faster processing and save memory space by weakening rapid changes through calculating an average time window data having a pulse length of n samples. The round counter filter receives the samples collected by the detection unit 105 and passed through the cutoff element 108 to the round counter processor 110 of FIG. 1A. For each sample which is different than a previous sample, the round counter filter subtract its own value divided by n and adds a new sample divided by n, which may be represented as:

$$\text{Filter} = \text{Filter} - \frac{\text{Filter}}{n} + \frac{\text{Sample}}{n}$$

Step 705 discloses a state machine, which executes the various states 0 (step 710), state 1 (step 740), state 2 (step 750), state 3 (step 760) that are performed by the round counter processor 110 of FIG. 1A. The first state that is designated is state 0 (step 710). Step 710 discloses the operation of the round counter processor 110 in state 0.

Step 715 is performed by the round counter processor 110 to determine whether a no activity time length detected by the detection unit 105 of FIG. 1A, which discloses generating a silent time window, which is a predetermined time length between firing two consecutive rounds. For example, the silent time window for the Negev between two rounds is seventy milliseconds. In accordance with some embodiments, step 715 is performed by comparing the round counter filter value n to a predetermined time length value, which in some cases is the silent time window. In some exemplary embodiments of the subject matter, the round counter processor 110 may designate the predetermined time length value of 105 milliseconds that represents two peaks of the energy pulses representing firing of two rounds. Where the round counter filter n value n is greater than the predetermined time length value after the time length of the silent window, the round counter processor 110 performs step 725. Step 725 discloses determining whether more than three peaks were recognized and whether the time length is greater than the time required for firing two rounds. For example, the time length is greater than 105 milliseconds. When the round counter processor 110 determines that three peaks were not recognized or that the time length is smaller than the time required for firing two rounds, step 726 is performed to check the wakeup window through performance of the steps described in connection with FIG. 5 by continuing execution of step 510 and the remaining method disclosed in FIG. 5 in detail. Optionally, step 727 discloses flagging an end of firing, which commands the round counter processor 110 to return to step 465 of FIG. 4B.

When three peaks are recognized and the time length is greater than the time required for firing two rounds the round counter processor 110 performs step 730 and transfers a command to the firing counter 120 of FIG. 1A to increase a firing count by two counts. Step 731, which is performed after firing of the firearm 100 has ceased, discloses determining that a last round was fired. The round counter processor 110 determines the last round was fired through execution of the steps disclosed in FIG. 6 commencing with step 600.

Optionally, step 732 discloses calculating the rate of firing. The round counter processor 110 transfers the round count and the time stamps before and after a standby mode was entered into to the RPM detector 140 of FIG. 1A. Time stamps are obtained from the time stamp logger 145 of FIG. 1A. The RPM detector 140 calculates the number of rounds fired within the time between standby modes through dividing the number of rounds fired by the elapsed time. The round counter processor 110 then returns to step 465 of FIG. 4B.

Returning to step 715, where the round counter filter n value is not greater than the predetermined time length value, the round counter processor 110 performs step 720 to determine whether a sharp rise in filter values occurred between samples. In some cases, the sampling is performed at 3000 hrz. In some cases, the determination in step 720 is made between samples taken within one third of a millisecond. Where no sharp rise in the filter value occurred, the round counter processor 110 performs step 465 in FIG. 4B. Where a sharp rise in the filter values occurs, the round counter processor 110 performs step 721, which discloses moving forward a peak counter. The round counter processor 110 counts a number of energy peaks that occur during an impact to the firearm 100. Step 722 discloses recognizing if three peaks were counted in the time length required for firing of one round. For example, the round counter processor 110 counts three peaks in a time length of forty milliseconds. Where three peaks are counted within the time length in step 722, the round counter processor 110 performs step 723 and increases the firing counter 120 by one count. Step 724 discloses jumping to state 1 (step 740 of FIG. 7B).

Referring now to FIG. 7B, the round counter processor 110 performs step 740 of entering state 1. In some embodiments of the subject matter, state 1 is performed to determine the maximum energy peak in the predetermined time length value, which comprises of received sample. To determine the maximum energy peak, the round counter processor designates a search time window in which the maximum energy peak is determined. For example, in the Negev, the search time length to determine the maximum energy peak can be 13 milliseconds.

Step 742 discloses determining a maximum peak value in the search time length. The round counter processor 110 determines the maximum peak value of energy in the search time window. Step 744 discloses determining whether the search time window has been reached, for example the length of 13 milliseconds. Where the search time window has not been reached the round counter processor 110 performs step 780 to return to wait for the next sample to be received. Where the search time window has been reached, the round counter processor 110 performs step 746 to jump to state 2 (step 750).

Step 750 discloses state 2. Step 752 discloses determining a peak drop of the maximum peak value found in state 1. Step 754 discloses determining whether the peak drop was found in a drop predetermined set time. A drop is about 30%-80% of the maximum peak value found in State 1. In some embodiments of the subject matter the drop is about 50% of the maximum peak value found in State 1. In some embodiments of the subject matter, where the drop predetermined set time comprises 17 milliseconds from the peak to the end of the drop. Where the drop was not found (there was no drop of 50% from the maximum peak value found in State 1) within the drop predetermined set time, the round counter processor 110 performs step 780 to return to wait for the next sample to be received. Where the drop of the maximum peak value is found within the drop predetermined set time, the round counter processor 110 performs step 756 disclosing to jump to state 3 (Step 760).

Step 760 discloses state 3. In state 3 the round counter processor 110 of FIG. 1A performs steps necessary to clean the signal noise received from the cutoff element 108. In some cases, the energy pulses (represented in the samples received) comprise interference that may be caused by other small impacts to the firearm 100 such as the firearm striking an object during the discharge, or the like. Persons skilled in the art will appreciate that other methods for cleaning signal noise can be employed to achieve the desired results of analyzing energy pulses that relate to discharging the firearm. Step 762 discloses selecting one or more samples for analysis within a signal cleaning predetermined set of time. The process of selecting the one or more samples can be for example through selecting every second or third sample received for processing and discarding of non-selected samples, thus avoiding interferences between energy pulses (represented in the samples). Step 764 discloses determining whether the signal cleaning predetermined set of time passed, for example 7 milliseconds. Where the signal cleaning predetermined set of time did not pass, the round counter processor 110 performs step 780 to return to wait for the next sample to be received. Where the signal cleaning predetermined set of time did pass, the round counter processor 110 performs step 768 to return to state 0 (step 710).

Figure 8A:
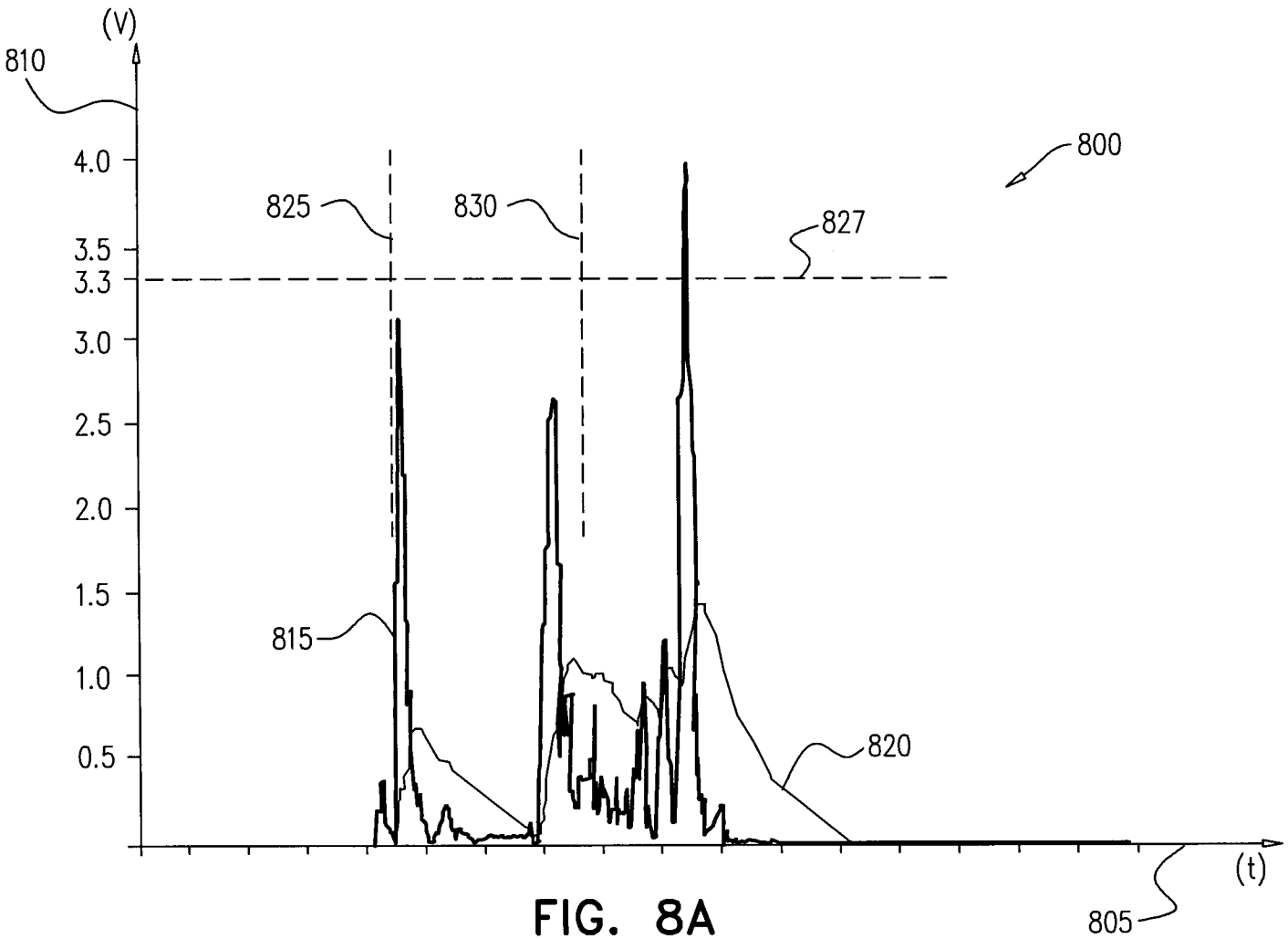
FIGS. 8A-8C show graph representations of impacts to a firearm collected by a round counter, according to some exemplary embodiments of the subject matter.

FIG. 8A shows a graph representation of a firing impact to the firearm 100 of FIG. 1A, according to some exemplary embodiments of the subject matter. The graph 800 comprises of a time axis 805, which represents a time over which data is sampled by the detection unit 105 of FIG. 1A. The graph comprises a voltage (V) axis 810, which represents a value of voltage measurements collected by the detection unit 105 of FIG. 1A. Plot 815 represents a signal measure by the detection unit 105. Plot 827 represents a voltage cutoff applied to the signal by the cutoff element 108 of FIG. 1A. Where the round counter 101 of FIG. 1A is in standby mode, the signal represented by plot 815 returns the round counter processor 110 to an active mode when a maximum energy peak is detected by the round counter processor 110 as explained in further detail in connection with the above figures. Plot 820 represents the round counter filter n value generated by the round counter processor 110. The data represented by plot 820 is the data used by the round counter processor 110 to count a number of rounds fired from the firearm 100. For example, a time window data is represented in the Figure with a beginning time value 825 and an ending time value 830. The round counter processor 110 analyzes the time window data to determine whether a round was fired by the firearm 100 as is described in further detail in the method described in FIG. 5.

Figure 8B:
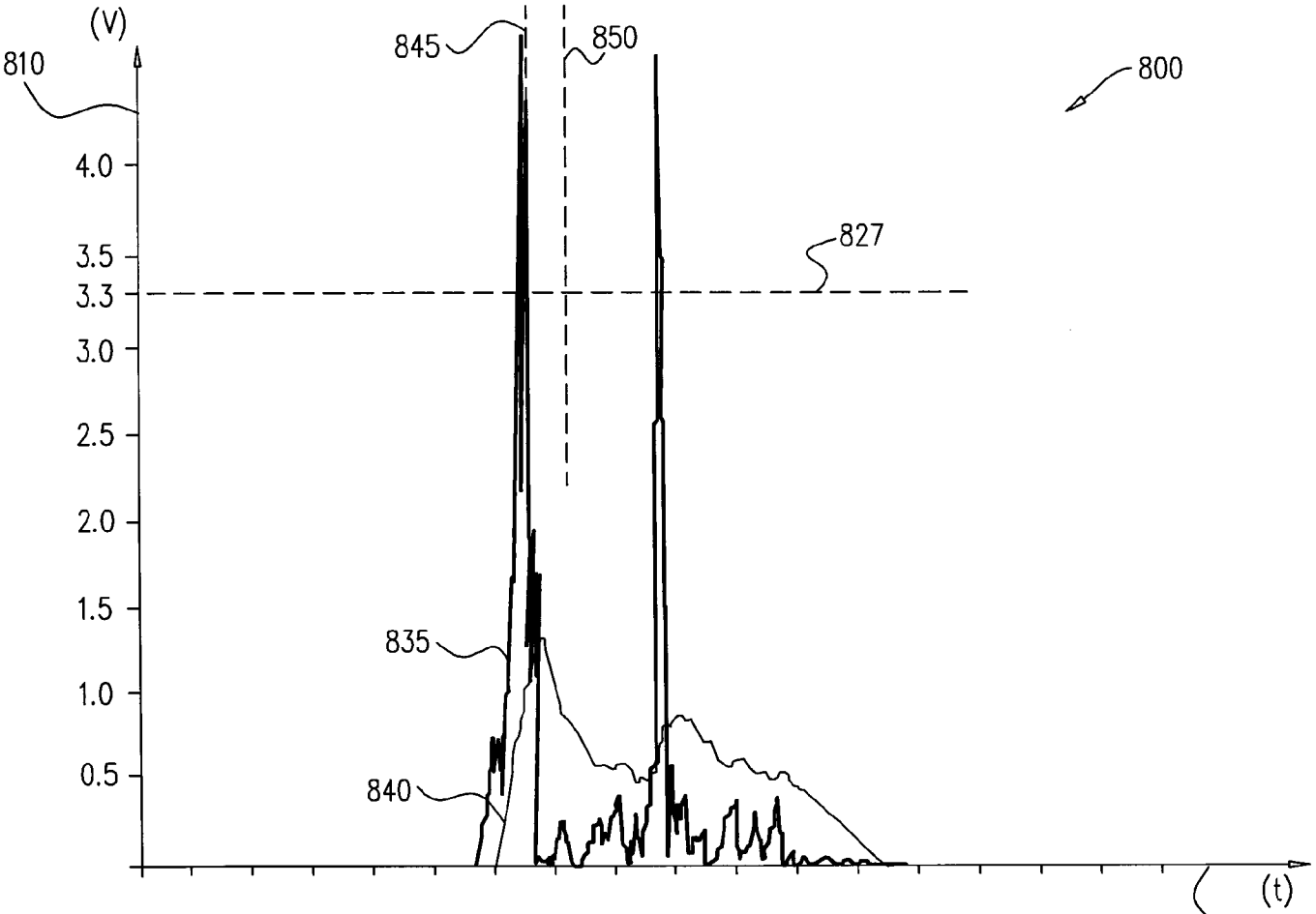

FIG. 8B shows a graph representation of a release impact to the firearm 100, according to some exemplary embodiments of the subject matter. A plot 835 represents samples collected by the detection unit 105. Plot 840 represents the round counter filter n value generated by the round counter processor 110. For example, a release time window is represented with a beginning time value 845 and an ending time value 850. The round counter processor 110 analyzes the time window data to determine whether the time window data is some other impact, e.g. releasing, that did not result from firing the firearm 100 as further detailed in the method described in FIG. 5.

Figure 8C:
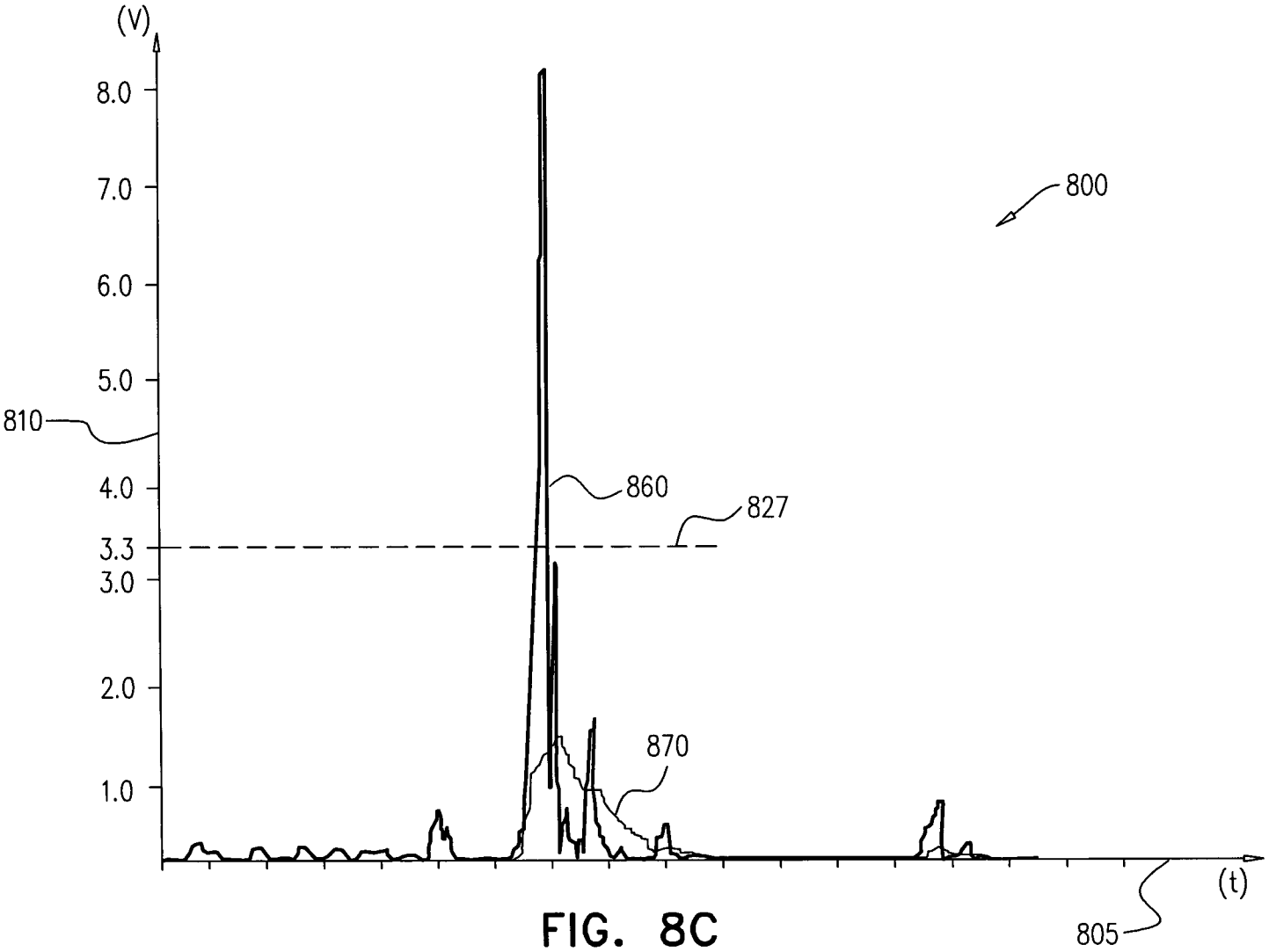

FIG. 8C shows a graph representation of a random impact to the firearm 100, according to some exemplary embodiments of the subject matter. Plot 860 represents a signal resulting from some impact to the firearm which is measured by the detection unit 105. Plot 870 shows the representation of a firearm impact sampled by the round counter processor 110. The round counter processor 110 determines the values of the sample result from some random impact to the firearm 100, as is further detailed in FIG. 5.

Figure 9:
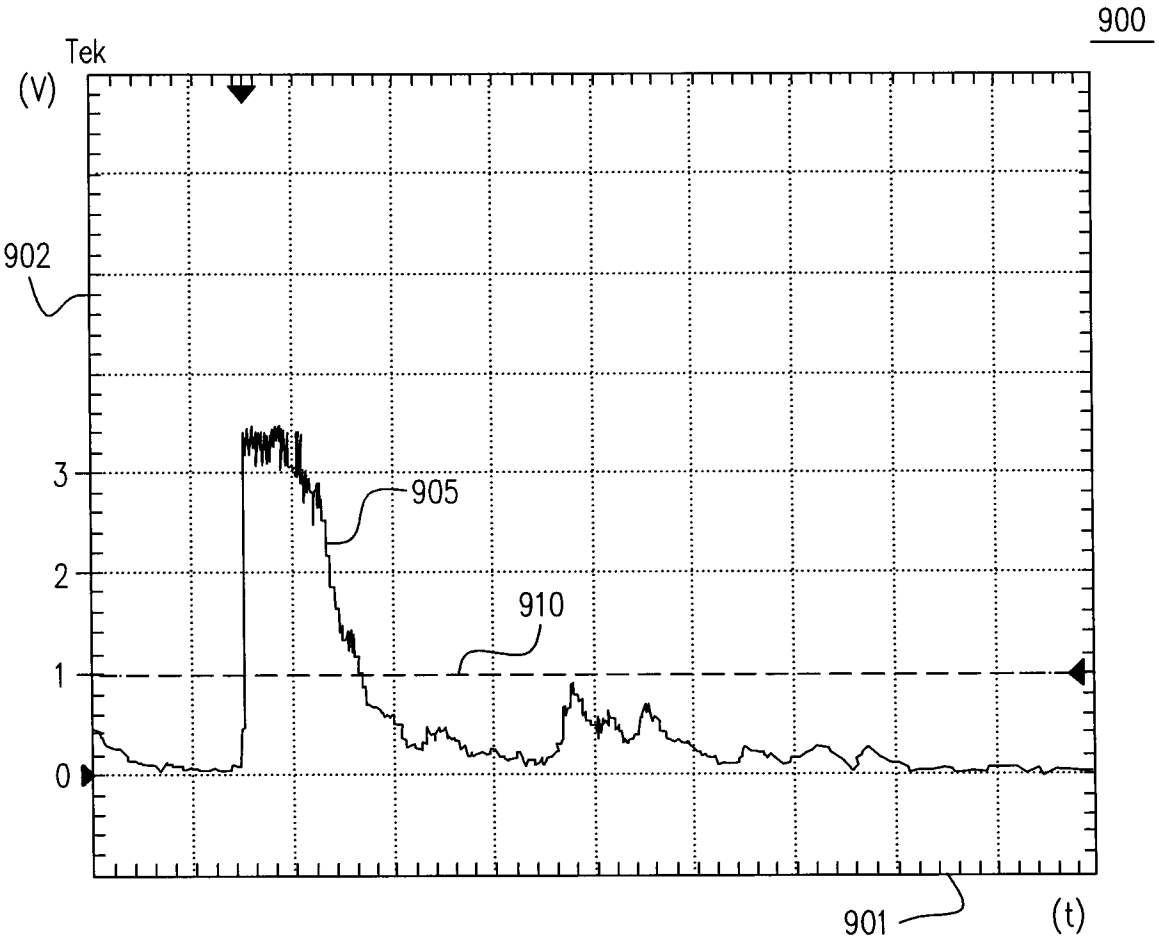
FIG. 9 shows a graph representation of a release as detected by a round counter on a firearm, according to some exemplary embodiments of the subject matter.

FIG. 9 shows a graph representation of a release as detected by a round counter on a firearm, according to some exemplary embodiments of the subject matter. The graph comprises a time (t) axis 901 and a voltage (V) axis 902. A plot 905 represents samples data analyzed by the round counter 101 of FIG. 1A. The plot 905 represents data analyzed by the round counter 101 where the firearm 100 of FIG. 1A which the round counter is located is a Negev. Plot 910 represents a voltage cutoff applied to the signal by the cutoff element 108 of FIG. 1A. The plot 910 comprises a single energy pulse, which when analyzed in the method detailed in FIG. 5 determines that the energy pulse is of a release in the firearm 100 that does not result in a discharge a round.

Figure 10:
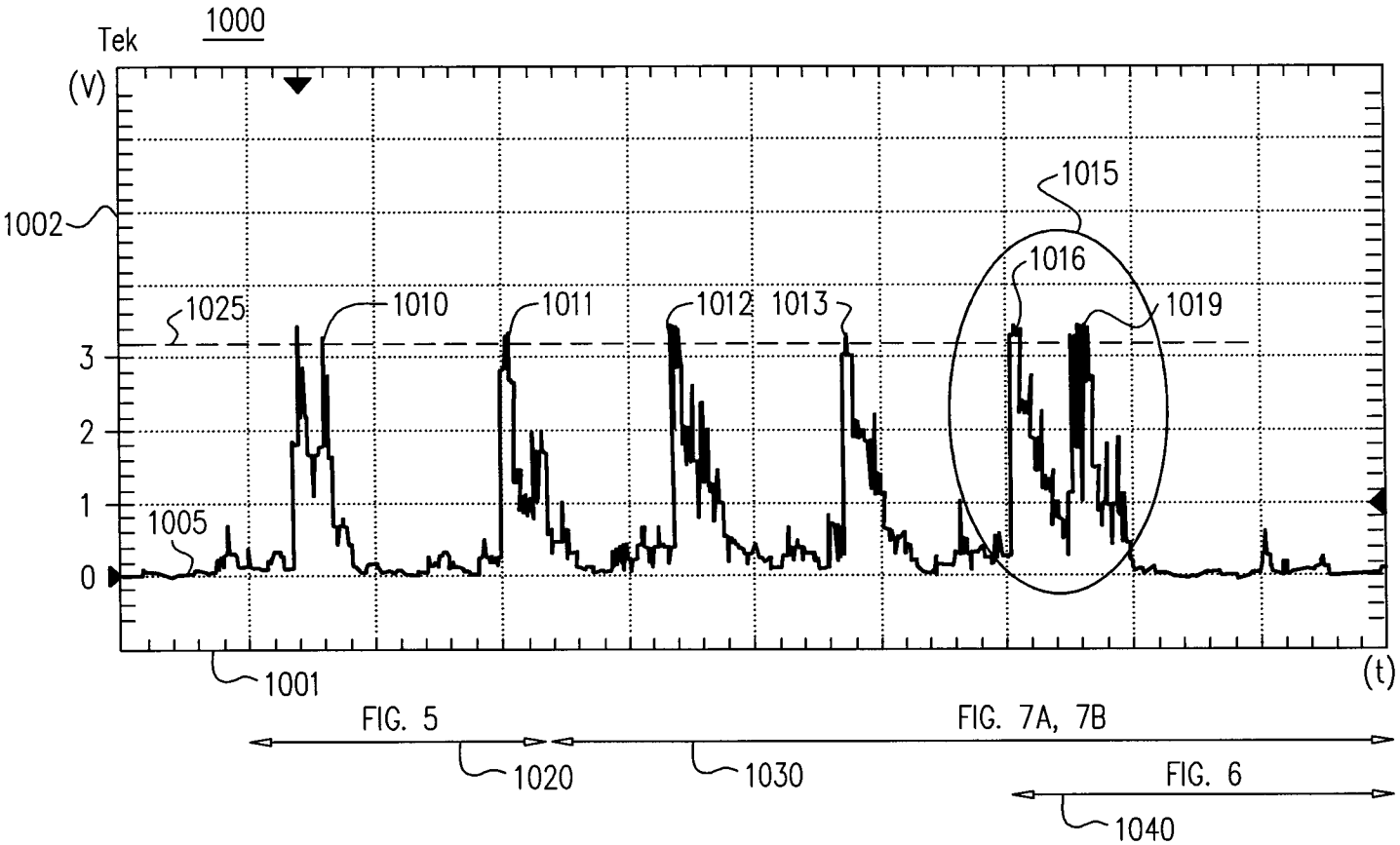
FIG. 10 shows a graph representation of firing five round as detected by a round counter on a firearm, according to some exemplary embodiments of the subject matter; and, FIG. 11 shows a graph representation of firing a five round burst with a final non-firing energy pulse as detected on a firearm by a round counter, according to some exemplary embodiments of the subject matter.

FIG. 10 shows a graph representation of firing five rounds as detected by a round counter on a firearm, according to some exemplary embodiments of the subject matter. The graph comprises a time (t) axis 1001 and a voltage (V) axis 1002. A plot 1005 represents samples data analyzed by the round counter processor 110 of FIG. 1A. The plot 1005 represents data analyzed by the round counter 101 where the firearm 100 of FIG. 1A on which the round counter is located is a Negev. Plot 1025 represents a voltage cutoff applied to the signal by the cutoff element 108 of FIG. 1A. The plot comprises of a first energy pulse peak 1010, a second energy pulse peak 1011, a third energy pulse peak 1012, a fourth energy pulse peak 1013, a fifth energy pulse peak 1016, and a final peak 1019. The first energy pulse peak 1010 is analyzed (1020) according to the method disclosed in FIG. 5, where the round counter 101 returns to active mode after the detection unit 105 of FIG. 1A detects a first impact. The second energy pulse peak 1011, the third energy pulse peak 1012, and the fourth energy pulse peak 1013, which represent consecutive rapid firing of the firearm 100 are analyzed (1030) according to the method of FIGS. 7A, 7B. The fifth energy pulse peak 1016, and the final peak 1019 are analyzed (1040) according to the method disclosed in FIG. 6. The fifth energy pulse peak 1016 and the final peak 1019 are determined to not be only a single count 1015, because the final peak 1019 is determined to be some other impact. Thus the number of rounds discharged by the Negev is counted as five by the round counter 101.

Figure 11:
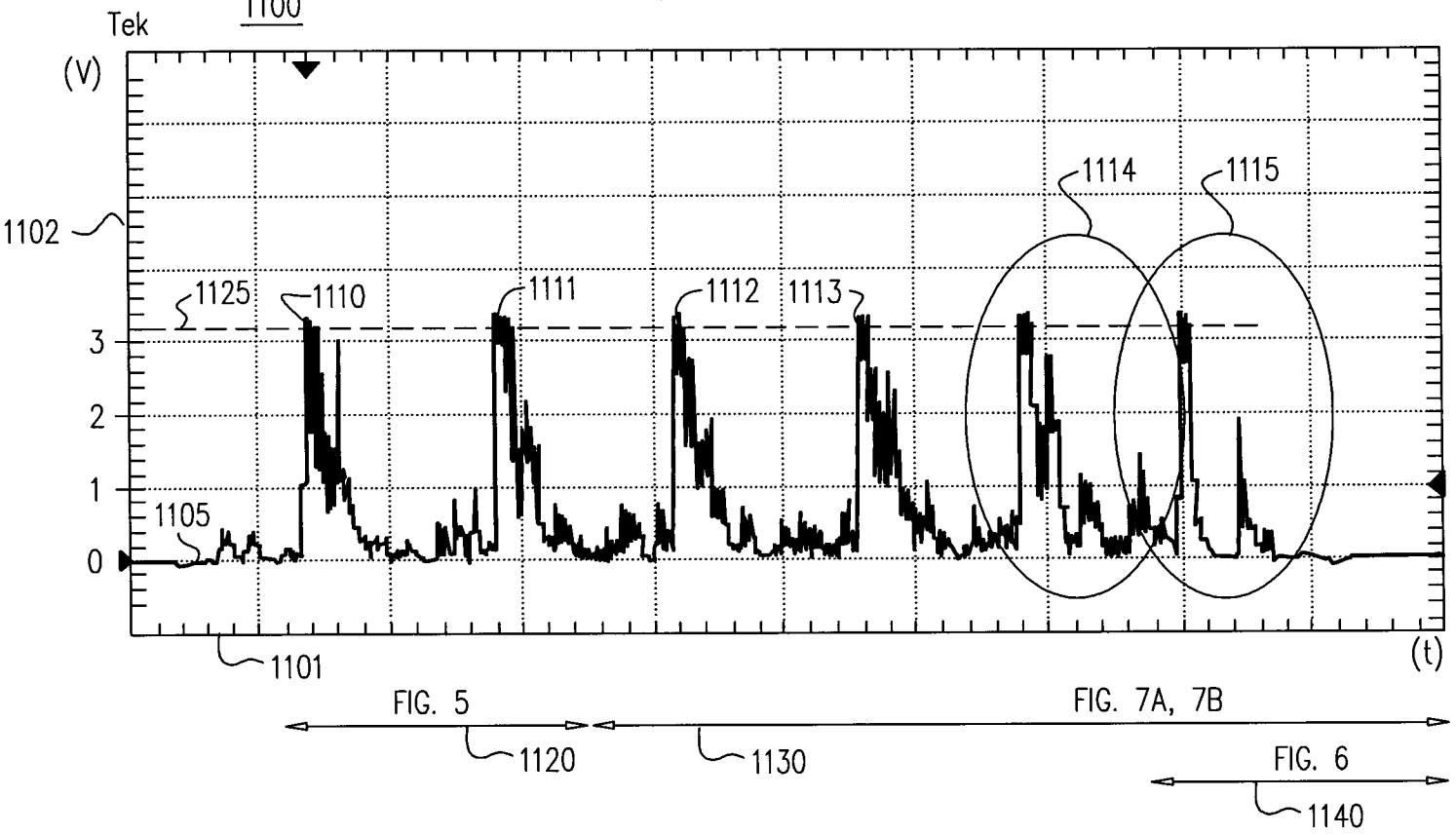

FIG. 11 shows a graph representation of firing a five round burst with a final non-firing energy pulse as detected on a firearm by a round counter, according to some exemplary embodiments of the subject matter. The graph comprises a time (t) axis 1101 and a voltage (V) axis 1102. A plot 1105 represents samples data analyzed by the round counter processor 110 of FIG. 1A. The plot 1105 represents data analyzed by the round counter 101 where the firearm 100 of FIG. 1A which the round counter is located is a Negev. Plot 1125 represents a voltage cutoff applied to the signal by the cutoff element 108 of FIG. 1A. The plot comprises of a first energy pulse peak 1110, a second energy pulse peak 1111, a third energy pulse peak 1112, a fourth energy pulse peak 1113, a fifth energy pulse peak 1114, and a sixth energy pulse peak 1115. In this representation, the first energy pulse peak 1110 and the second energy pulse peak 1111 are analyzed (1120) according to the method disclosed in FIG. 5. In this case the time window data of the round counter 101 comprises the first energy pulse peak 1110 and the second energy pulse peak 1111 and the round counter 101 increases the firing counter 120 of FIG. 1A by two counts as disclosed in FIG. 5. The third energy pulse peak 1112, the fourth energy pulse peak 1113, the fifth energy pulse peak 1114, and the sixth energy pulse peak 1115 are analyzed (1130) as detailed in the method disclosed in FIGS. 7A, 7B for rapid fire of the firearm 100. All energy pulse peaks are counted by the round counter 101. However, once the round counter 101 performs the method of disclosed in FIG. 6 (1140) to determine whether a final pulse was a firing of the firearm, the round counter 101 determines the sixth energy pulse peak 1115 does not result from the firing of the firearm 100 and removes a count from the firing counter 120 in accordance with the method disclosed in FIG. 6.

While the disclosure has been described with reference to exemplary embodiments, it will be understood by those skilled in the art that various changes may be made and equivalents may be substituted for elements thereof without departing from the scope of the subject matter. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this subject matter, but only by the claims that follow.

The invention claimed is:

1. A round counter, comprising:

a detection unit configured to detect energy pulses resulting from an impact to a firearm;

a round counter processor configured to analyze data of an energy pulse related to the impact to the firearm obtained by the detection unit to count a number of rounds fired from the firearm;

wherein the round counter processor is configured to:

designate a wakeup time window having a substantial time span of firing at least two rounds;

designate a plurality of energy pulse time windows for accumulating data of the energy pulse, wherein at least one energy pulse time window of the plurality of energy pulse time windows has a time length of at least one energy pulse;

wherein the round counter processor compares the at least one energy pulse time window to a firing window, wherein the firing window is a predetermined time length required for discharging a round from the firearm;

a firing counter configured to store a firing count which indicates the number of rounds discharged from the firearm; wherein the firing count is increased when the round counter processor determines the at least one energy pulse time window is larger than the firing window; wherein the time length of the at least one energy pulse time window is greater than a predetermined time length; and, an energy source to power the round counter.

2. The round counter of claim 1, further comprising:

an other impact counter configured to store a number of other impacts to the firearm;

wherein the round counter processor compares the at least one energy pulse time window to a random impact window, wherein the random impact window is a predetermined time length of a random impact occurring to the firearm;

wherein the other impact counter is increased by one when the round counter processor determines the at least one energy pulse time window is not greater than the random impact window.

3. The round counter of claim 1, further comprising:

a release counter configured to store a release count, which indicates a number of times a release is performed on the firearm;

wherein the round counter processor compares the at least one energy pulse time window to a release window, wherein the release window is the predetermined time length required for the release of the firearm;

wherein the release counter is increased by the count of one if the round counter processor determines the at least one energy pulse time window is smaller than the release window.

4. The round counter of claim 1, further comprising a transceiver configured to transmit the data stored in the round counter to a server.

5. The round counter of claim 4, wherein the round counter operates in an engagement mode to collect the data of the energy pulse related to impacts to the firearm without transmitting and receiving the data.

6. The round counter of claim 1, wherein an external case comprises the round counter processor, the firing counter, a release counter, an other impact counter, and a transceiver.

7. The round counter of claim 1, further comprising a time stamp logger for obtaining a time stamp associated with an energy pulse.

8. The round counter of claim 1, wherein the round counter processor is configured to calculate a rate of fire.

9. The round counter of claim 1, wherein the round counter processor configured to analyze a heavy firing sequence of the firearm.

10. A computer-implemented method performed by a round counter, comprising:

detecting energy pulses resulting from an impact to a firearm;

analyzing data of an energy pulse related to the impact to the firearm obtained by the detection unit to count a number of rounds fired from the firearm designating a wakeup time window having a substantial time span of firing at least two rounds;

designating a plurality of energy pulse time windows for calculating and accumulating the data of the energy pulse, wherein at least one time window of the plurality of energy pulse time windows has a time length of at least one energy pulse;

comparing the at least one energy pulse time window to a firing window, wherein the firing window is a predetermined time length required for discharging a round from the firearm; and, storing a firing count, which indicates the number of rounds discharged from the firearm;

increasing the firing count if the at least one energy pulse time window is greater than or equal to the firing window; wherein the time length of the at least one energy pulse time window is greater than a predetermined time length.

11. The method of claim 10, further comprising:

determining whether a no activity time length detected by the detection unit is equal to a substantial time span between firing of two rounds, comparing a round counter filter value to a predetermined time length value;

determining whether more than three peaks are recognized from the beginning of the wakeup time window and whether the time length of the three peaks is greater than a time required for firing two round when the round counter filter value is equal to the predetermined time length value;

based on the determination, increasing firing count by two counts;

determining whether less than three peaks are recognized from the beginning of the wakeup time window or whether the time length from the beginning of the wakeup time window is smaller than the time required for firing the two rounds;

determining the at least one energy pulse time window is not greater than a random impact window, wherein the random impact window is a predetermined time length of a random impact occurring to the firearm; and, based on the determinations, increasing the random impact count by a count of one.

12. The method of claim 11, further comprising:

determining whether the at least one energy pulse time window is greater than or equal to the firing window and whether a first energy pulse width is greater than a predetermined energy pulse width when the time length from the beginning of the wakeup time window is smaller than the wakeup time window; and, based on the determination, increasing the firing count by one.

13. The method of claim 11, further comprising:

determining the at least one energy pulse time window is greater than a random impact window, wherein the random impact window is a predetermined time length of a random impact occurring to the firearm;

comparing the at least one energy pulse time window to a release window, wherein the release window is the predetermined time length required for a release impact to the firearm;

determining the at least one energy pulse time window is smaller than the release window; and, increasing the release count by a count of one.

14. The method of claim 11, further comprising:

determining whether the at least one energy pulse time window is smaller than the firing window or whether a first energy pulse width is smaller than a predetermined energy pulse width when the time length from the beginning of the wakeup time window is smaller than the wakeup time window; and, based on the determination, increasing the release count by a count of one.

15. The method of claim 11, further comprising:

determining the at least one energy pulse time window is greater than a release window, wherein the release window is the predetermined time length required for release the firearm; and, increasing the firing count by two counts if the at least one energy pulse time window is greater than the wakeup time window.

16. The method of claim 10, further comprising:

initializing a round counter hardware;

initializing parameters and variables of the round counter; and, setting the round counter to a standby mode for conservation of power.

17. The method of claim 16, wherein parameters are received wirelessly using a transceiver of the round counter.

18. The method of claim 10, further comprising:

setting the round counter to a standby mode for conservation of power;

switching the round counter to a standard activity mode when the energy pulse related to the impact is detected; and, returning the round counter to the standby mode when no further energy pulses are detected.

19. The method of claim 10, further comprising:

determining the firearm is not an open bolt firearm;

retrieving an energy pulse value from a last received pulse;

determining a rate of decrease is greater than a predetermined decrease rate; and, reducing the firing count by one count.

20. The method of claim 10, further comprising:

determining the firearm is an open bolt firearm;

determining a ratio between a last measured energy pulse value maximum and a previously measured energy pulse value maximum;

determining whether said ratio is smaller than a predetermined ratio value; and, based on the determination, reducing the firing count by one.

* * * * *